US005480095A

United States Patent [19]

Stevenson et al.

[11] Patent Number: 5,480,095

[45] Date of Patent: Jan. 2, 1996

[54] ACTUATOR AND CONTAINER FOR DISPENSING FLUIDS

[75] Inventors: William W. Stevenson, Lake Elmo; John C. Ruta, White Bear Lake; W. Bruce Sandison, St. Louis Park; Russell E. Blette, Hastings, all of Minn.

[73] Assignee: Minnesota Mining and Manufacturing Company, St. Paul, Minn.

[21] Appl. No.: 260,527

[22] Filed: Jun. 16, 1994

Related U.S. Application Data

[63] Continuation-in-part of Ser. No. 121,270, Sep. 14, 1993, abandoned.

[51] Int. Cl.[6] ..... B65D 83/14; B65D 83/16; B05B 1/34; B05B 11/00

[52] U.S. Cl. ..... 239/104; 222/109; 222/402.1; 239/337; 239/588; 239/589; 239/591

[58] Field of Search ..... 239/337, 588, 239/229, 591, 589, 573, 104; 222/402.1, 109

[56] References Cited

U.S. PATENT DOCUMENTS

| | | | |
|---|---|---|---|
| 2,963,228 | 12/1960 | Hait | 239/229 |
| 2,981,482 | 4/1961 | Warren | 239/229 |
| 3,101,876 | 8/1963 | Ayres | 239/337 |
| 3,108,590 | 10/1963 | Gorman | 128/173 |
| 3,246,850 | 4/1966 | Bourke | 239/562 |
| 3,272,403 | 9/1966 | Alexander | 222/402.1 |
| 3,283,962 | 11/1966 | Whitmore | 239/337 |
| 3,617,000 | 11/1971 | Probst | 239/591 |
| 4,850,517 | 7/1989 | Ter Stege | 239/337 |
| 5,193,748 | 3/1993 | Wittersheim et al. | 239/337 |

FOREIGN PATENT DOCUMENTS

| | | | |
|---|---|---|---|
| 0505630A1 | 9/1992 | European Pat. Off. | B26B 21/44 |
| 2214555 | 8/1990 | Japan . | |
| 598923 | 3/1948 | United Kingdom . | |
| 2186916 | 8/1987 | United Kingdom | B65D 83/14 |
| 2198189 | 6/1988 | United Kingdom | 222/402.1 |

*Primary Examiner*—Andres Kashnikow

*Attorney, Agent, or Firm*—Gary E. Griswold; Walter N. Kirn; Leland D. Schultz

[57] ABSTRACT

Disclosed is a fluid dispensing container and an actuator therefor that attenuates accumulation of solidified sprayed fluid.

31 Claims, 11 Drawing Sheets

ACTUATOR AND CONTAINER FOR DISPENSING FLUIDS

This application is a C-I-P application of Ser. No. 08/121, 27 , filed Sep. 14, 1993, now abandoned.

FIELD OF THE INVENTION

This invention relates to actuators for dispensing fluids from containers,

BACKGROUND OF THE INVENTION

Containers have been known in the art for dispensing fluids under pressure. The fluid may be expelled in the form of an aerosol spray, that is fine droplets. For the purposes of this invention, the term "aerosol" means "suspensions or dispersions of fine solid or liquid particles, foams, syrups, or powders in a gas." Alternatively, the fluid may be expelled in the form of a stream of liquid, rather than in an aerosol spray.

An example of one such device is shown in FIG. 1, The container 10 includes a container body, or can 12 that typically is cylindrical and hollow, and includes reservoir 14 for receipt of a quantity of a fluid 16, The cavity 14 is enclosed on its bottom end by bottom closure 18, and on its upper end by top closure 20, As illustrated, in FIG. 1, top closure 20 includes a first top closure portion 20*a*, and a second top closure portion 20*b*. Access opening 22 is formed in the upper closure 20 communicating with reservoir 14 for egress of the fluid 16 from one container.

One conventional dispensing system expels fluid from the container by means of a pump or like mechanism placed in communication with the fluid within a reservoir. In this case it is not necessary to place the fluid under pressure while in storage within the container. The following is nonexclusive list of commercially available pump mechanisms for expelling a fluid from a container: Seamist and Euromist II Brand pumps available from Seaquist Dispensing, Division of Aptar Group of Cary, Ill., or with a Precision Aeropump Brand pump available from the Precision Valve Corporation of Yonkers, N.Y.

Frequently however, a dispensing system is utilized in which the fluid 16 in the reservoir is subject to pressure sufficient to expel the pressurized fluid through the access opening 22, to the exterior of the container body 12. Therefore, all of the components of the container forming the body 12 are constructed from materials, such as metallic materials, that may be effectively sealed in fluid tight relationship and withstand the pressure applied when filled with a fluid to be dispensed.

Such fluids 16 may include a mixture of a first fluid, such as indicated at 16 in FIG. 1, to be expelled from the container and a second fluid or phase, such as propellant 17, contained under pressure (such as in the head space 24 between the fluid 16 and the upper closure 20). It is this type of conventional spray container that is shown in FIGS. 1–3A and will be discussed herein in greater detail.

Referring now in particular to FIGS. 1 and 1A, sprayhead assembly 24 is mounted on the container 12 to control the dispensing of the fluid 16 from the container. Sprayhead assembly 24 includes actuator or push button 26. As illustrated in FIG. 1, actuator 26 includes stem 28, slidingly received in fluid tight relationship within access opening 22, and a top surface 30 adapted for convenient manual engagement.

Actuator 26 includes passageway 32 that extends from a first end 34, through stem 28 and the actuator body, to a second end 36. At least one slot 29 is formed in the stem adjacent to the first end 34 and communicating with passageway 32. The number, size, and length of the slots may be selected to regulate the flow of fluid through the actuator.

The second end 36 includes a nozzle portion 38 mounted at second end 36 of passageway 32, terminating in orifice 40 of reduced diameter to meter the flow of fluid therethrough. The stem 28 is connected to a valve 39 mounted within the container body. Valve 39 may be of any suitable design for controlling the flow of fluid from the reservoir 14.

Gasket 41 is mounted between valve 39 and upper closure 20*b*. Stem 28 is slidingly received with aperture 41*a* and sealed by gasket 41. Valve seat 42 is mounted within cavity 43 of the valve and is in contact with the end of stem 28. Spring 45 is mounted in cavity 43 of the valve and is in contact with valve seat 42. Spring 45 urges valve seat 42 in direction 46 to a closed, sealed position wherein the valve seat 42 seals against gasket 41, supported by top closure 20*b*. Slot 29 is located below gasket 41 to contain the fluid. If the actuator 26 is shifted in direction 48 against the force of spring 45, the valve is opened and fluid is able to flow past the valve seat 42 through slot 29 to the actuator passageway 32.

The type of actuator illustrated is "female" type. A "male" type of actuator (not shown) would include a tubular projection from the valve that would be received within a cooperative cavity in the actuator. However for purpose of this invention, the term "actuator" will be understood to include both male and female actuators, unless otherwise indicated.

The sprayhead assembly 30 also includes a tube 50 that provides fluid communication between first end 34 of the passageway 32 and the distal portion of the reservoir 14, and the fluid contained therein. Tube 50 includes passageway 54, extending to a second end 60 adjacent to the bottom of the reservoir 14. Valve 39 includes a passageway 52 that extends from passageway 54 of tube 50 to cavity 43.

When valve seat 42 is shifted to the open position, fluid 16 is propelled by the pressure of the vapor phase of propellant 17, acting in direction 64, into second end 60 of the tube 56, through the tube, through passageway 54 of tube 50, passageway 52 and cavity 43 of valve 39, through passageway 32 of actuator 26 outwardly from the container.

As shown more particularly in FIG. 2, passageway 32 includes two contiguous segments 32*a* and 32*b*. Segment 32*a* extends from first end 34 through passageway 32 and is generally axially aligned (along axis 66) therewith. Segment 32*b* projects from segment 32*a* along axis 68 and determines the direction of the fluid dispersion from the actuator. The segments 32*a* and 32*b* form elbow 70 at their juncture.

In the past, it has been common to provide a propellant such as a liquified gas, that is a volatile organic compound, dissolved, dispersed or otherwise comixed with the compound with the fluid 16 being a material that is dissolved in the compound. It has also been known that when dispensed, a portion of the fluid 16 has a tendency to be deposited on surface within the sprayhead assembly and then solidify through evaporation of the solvent and propellant. By "solidified" it is meant that the deposits are solid, semi-solid or viscous layers in which the material from the fluid is highly concentrated. These solidified deposits tend to accumulate at any obstruction or sharp change in geometry in the passageway through which the fluid is conveyed (as at 72 in FIGS. 3 and 3A). Such locations in conventional sprayhead assemblies are formed at elbow 70 of passageway 32, at the end of stem 28 engaged with valve 39, and the interior side of the nozzle member about the orifice, all shown in FIGS. 3 and 3A. In addition, it has been observed that the fluid also tends to fall back, solidify and accumulate on the exterior of the actuator body about the orifice 40, as shown in FIGS. 3 and 3A.

Although undesirable, this accumulation of solidified material has not presented a significant problem in the past. When the dispensing of the fluid with a volatile organic compound based solvent and propellant were resumed, the compound contained in the newly ejected fluid stream redissolved or redispersed the accumulated material and thus prevented substantial interference with, or blockage of, the operation of the container.

More recently, concern over environmental effects of the use of volatile organic compounds has made the use of other solvents, such as water, more desirable. It has been observed however, that water dissolvable and/or dispersable fluids that accumulate within the passageway 32 or above the actuator are generally not redispersed or redissolved when dispensing of the fluid is resumed. The accumulation shown in FIGS. 3 and 3A continues to increase to the point where significant restriction of the passageway, or even outright blockage, occurs with clear detrimental effect on the operation of the container.

Thus, it is desirable to provide an actuator for a fluid dispenser that attenuates accumulations of solidified material within the passageway of the actuator, particularly with water based fluids.

SUMMARY OF THE INVENTION

The present invention provides an actuator for use with a dispenser for a fluid. The actuator includes an actuator body and a passageway smoothly extending in a curvilinear manner through the actuator body from an inlet end to an outlet end, for conveying the fluid from the inlet end to the outlet end thereof while attenuating accumulation of solidified material from the fluid within the passageway and on the actuator body.

In one embodiment of the actuator, the actuator includes a dispensing tube having an inlet end and an outlet end and defining the passageway extending between the inlet end and the outlet end of the dispensing tube. Means are provided for mounting the dispensing tube on the actuator body. Means are also provided for deflecting a portion of the dispensing tube while mounted on the actuator body, wherein the passageway extends smoothly in a curvilinear manner between the inlet end and the outlet end to attenuate the accumulation of solidified material from the fluid during dispensing of the fluid.

In yet another embodiment of the invention, the dispensing tube and the actuator body are formed from a unitary body and includes means for deflecting a portion of the dispensing tube, wherein the passageway extends smoothly in a curvilinear manner between the inlet end and the outlet end.

The present invention further provides the actuator operatively mounted on a container containing a quantity of the fluid, and a valve for controlling the dispensing of the fluid from the container while attenuating the accumulation of solidified material from the fluid during dispensing of the fluid.

A method of making the actuator is disclosed that includes the steps of: providing a mold having a cavity shaped like the actuator; providing a sacrificial section extending in said mold cavity between a first location and a second location; filling the mold cavity with a moldable material and allowing the moldable material to solidify within the mold cavity about the sacrificial section; destroying the sacrificial section within the molded actuator body to open the passageway and a first opening and a second opening; and removing the molded actuator body from the mold.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Figure 1:
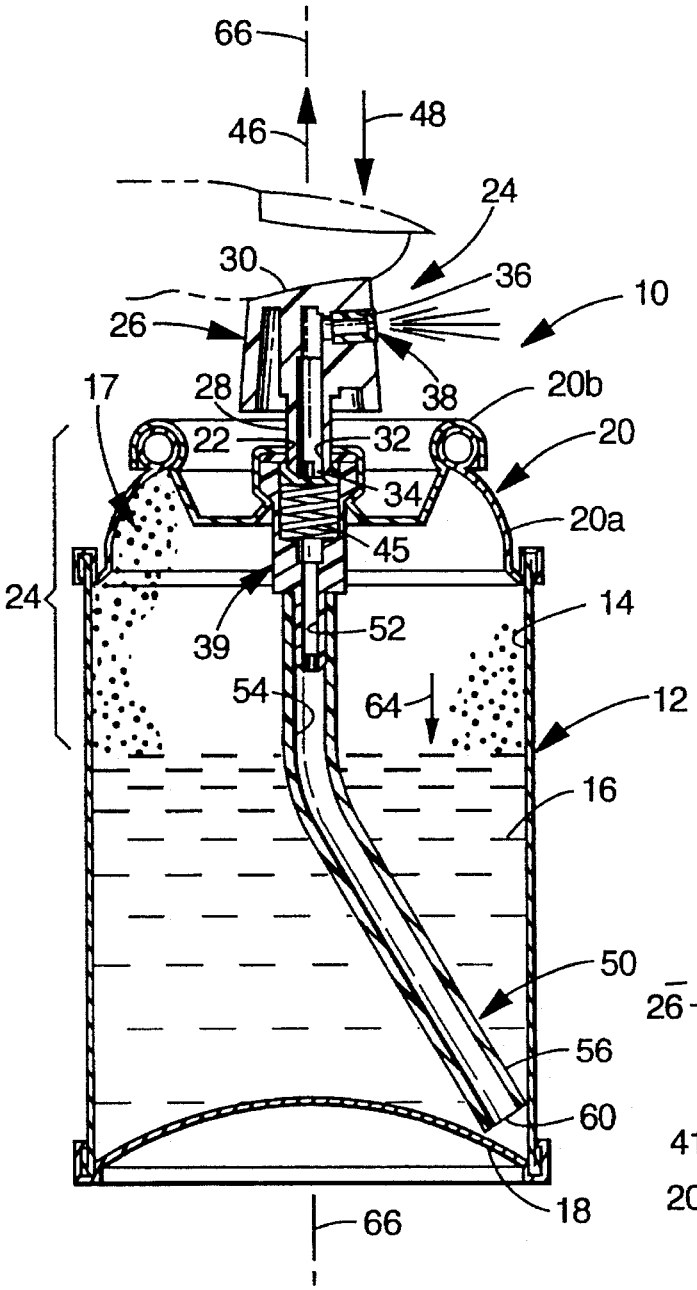
Fig. 1 PRIOR ART
FIG. 1 is a cross-sectional view of an aerosol spray applicator with a conventional actuator.
Figure 1A:
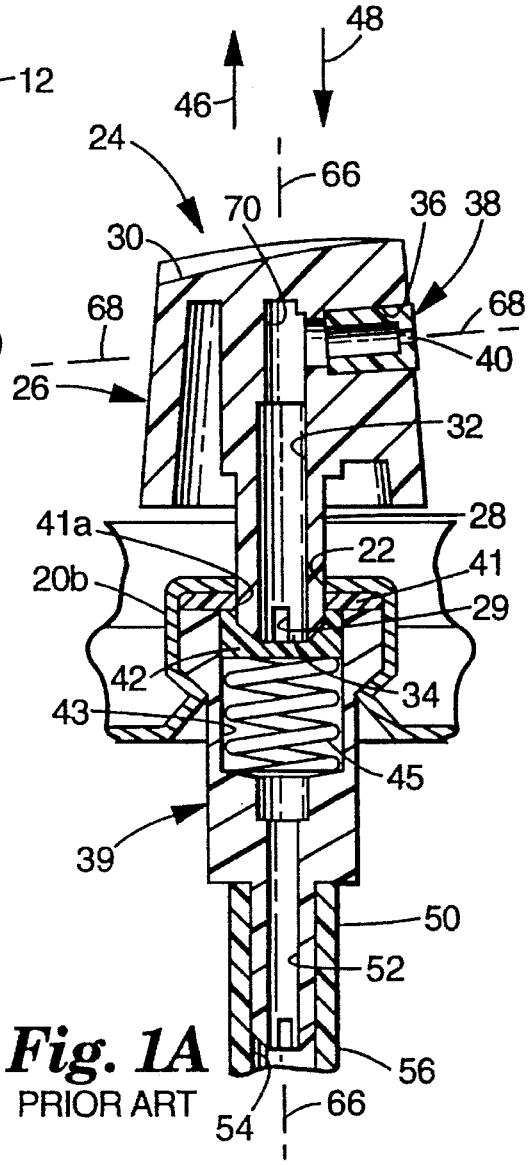
Fig. 1A PRIOR ART
FIG. 1A is a magnified partial view of the sprayhead assembly of the aerosol spray applicator of FIG. 1.
Figure 2:
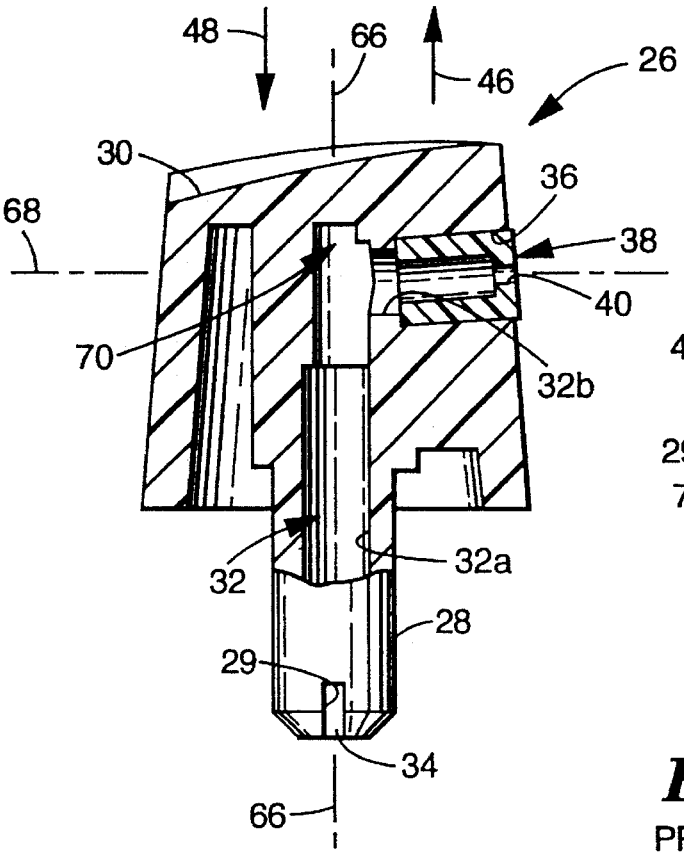
Fig. 2 PRIOR ART
FIG. 2 is a magnified cross-sectional view of the conventional actuator of FIG. 1.
Figure 3:
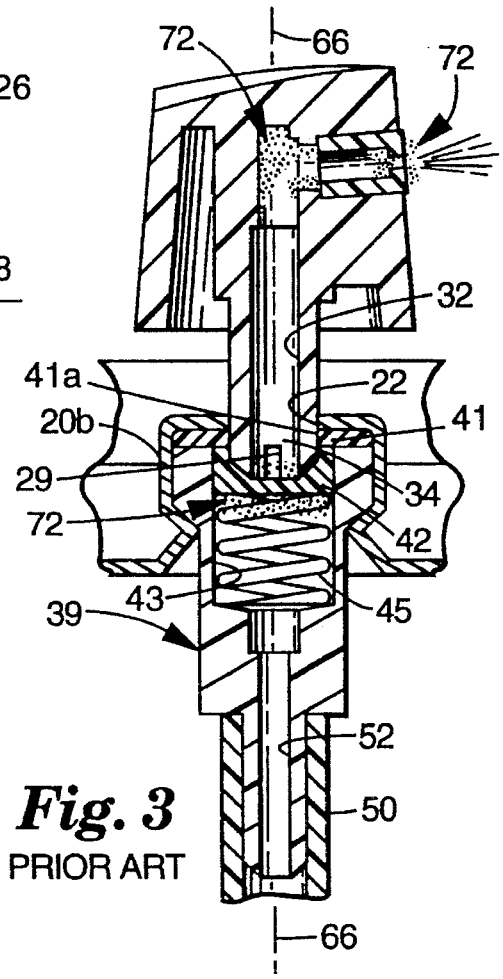
Fig. 3 PRIOR ART
FIG. 3 is a magnified partial cross-sectional view of a portion of the conventional actuator of FIG. 2 dispensing a fluid.
Figure 3A:
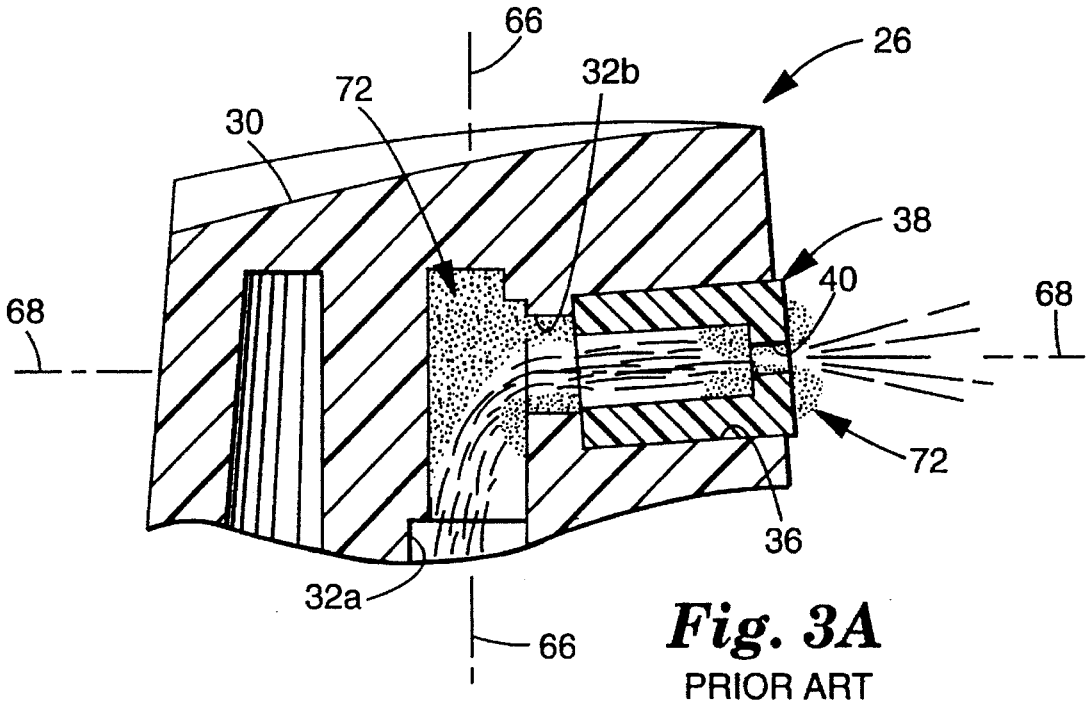
Fig. 3A PRIOR ART
FIG. 3A is a magnified partial view of the sprayhead assembly of the conventional aerosol spray applicator of FIG. 3 dispensing a fluid.

Referring now to FIGS. 4, 5A, 5B, 5C, 5D and 6, there is illustrated an actuator 100 according to the present invention. Although not illustrated, the present invention also encompasses actuator 100, such as the embodiment of the invention shown in FIGS. 5A, 5B, 5C, 5D and 6, connected to a tube 50, such as shown in FIG. 1, to form a sprayhead assembly and further may be operatively connected to a container 12 filled with a fluid. Preferably, the container is an aerosol spray container and the fluid is stored under pressure, such as previously described with respect to FIGS. 1–3A. For purposes of this invention, the term "fluid" includes any and all liquids, gases, particulate solids, or like flowable materials capable of being expelled under pressure in conjunction with the present invention. The following is a nonexclusive list of exemplary commercially available three piece tinplate aerosol containers that may be employed for use with the present invention: 202X406 (6 fluid ounces); 202X509 (8 fluid ounces); 211X604 (16 fluid ounces); and 300X709 (24 fluid ounces), three piece tinplate all available from Crown Cork and Seal Company of Philadelphia, Penna. and United States Can Company of Elgin, Ill., and 50 mm by 190 mm (336 cc); 59 mm by 185 mm (447 cc); 66 mm by 235 mm (708 cc), one piece aluminum construction, all available from EXAL Corporation of Youngstown, Ohio, and Advanced Monobloc Corporation of Hermitage, Penna.

The following is a nonexclusive list of fluids, including water based and hydrocarbon based adhesives, hydrocarbon based propellants and hydrocarbon based solvents that may be employed with the actuator and aerosol spray container of the present invention:

CONCENTRATES

1. Solvents

Hexane, Cyclohexane, Heptane, Toluene, Methyl Ethyl Ketone, Ethanol, Water, Pentane, 1,1,1-Trichloroethane.

2. Adhesives

Styrene Butadiene, Acrylic, Neoprene, Nitrile, Block Polymers, Block co-polymers.

PROPELLANTS

Butane, Butene, Isobutane, Propane, Dimethyl Ether, Difluoroethane, Carbon Dioxide, Nitrogen, air.

It is to be understood that the actuator of the present invention may be employed with other fluid dispensers, such as those employing pumps (not shown) or those dispensing the fluid in a stream, rather than as droplets in an aerosol spray.

In the present invention, the actuator 100 is adapted to attenuate the accumulation of solidified fluid material 16 within the actuator, even with water based solvents. For purposes of this invention, the term "attenuate" includes the prevention, reduction or elimination of solidified material from the fluid being dispensed within the fluid dispensing container of the present invention. For purposes of this invention, the term "solidified" material includes solid, semisolid or viscous bodies of material concentrated from the fluid.

Figure 4:
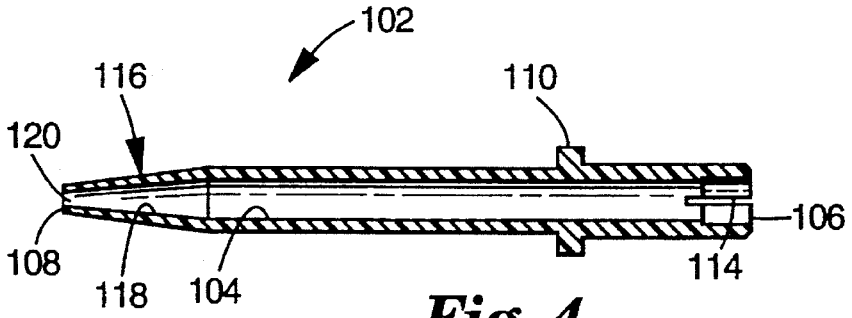
FIG. 4 is a cross sectional view of a dispensing tube according to the present invention for use with an actuator.

In the embodiment illustrated in FIGS. 5A, 5B, 5C, 5D and 6, this is accomplished by providing, as part of the actuator 100, a dispensing tube 102 (shown in more detail in FIG. 4). The following is a nonexclusive list of materials from which dispensing tube 102 may be constructed for use in the present invention: polyethylene, high density polyethylene, polypropylene, polyacetal, polystyrene, polytetrafluoroethylene, and nylon. Alternatively, a smoothly deflectable dispensing tube may be constructed of any suitable material and the walls of the passageway coated or lined with a desired material, such as silicone or polytetrafluoroethylene.

The dispensing tube 102 forms passageway 104 therewithin, and extends between first end 106 and second end 108. Annular ring 110 projects from the tube at an intermediate location. First end 106 includes one or more axial slots 114, sized and located to control the flow of the fluid therethrough from the aerosol container cavity, when operatively connected thereto, as previously explained. The second end 108 of the dispensing tube includes nozzle portion 116 for controlling and directing the flow of fluid from the dispensing tube.

Although the dispensing tube 102 may be provided with a constant inner diameter throughout its length, in the preferred embodiment of the invention, the nozzle portion 116 includes an inner frusto-conical chamber 118 terminating in an orifice 120. In this arrangement the frusto-conical chamber 118 progressively directs the fluid being ejected into a more laminar and coherent flow, thus providing a more controlled and uniform dispersion or spray pattern.

One method (not illustrated) of producing the dispensing tube 102 of the present invention with a frustoconical chamber in the nozzle portion, includes heating a thermoplastic tube (not shown) at an intermediate location and then pulling ends of the tube in opposite directions. This induces a "necking" or narrowing of the tube at the heated section. The tube may then be divided at the "necked" portion to create two dispensing tubes having the inner frusto-conical chambers in the nozzle portions. Of course, the dispensing tube may be produced by any other suitable process, such as injection molding, or sacrificial molding.

In the embodiment of the present invention shown in FIGS. 5A–D and 6, actuator 100 includes a body 122 that defines a receptacle 124 therethrough for receipt of the dispensing tube through first opening 128, with a portion of the dispensing tube adjacent second end 108 projecting through second opening 130. In the preferred embodiment of the invention, the body 122 is most conveniently constructed by premolding a unitary molded body from a polymeric material. The following is a nonexclusive list of the polymeric materials that may be utilized to construct actuator body 112 in the embodiment of FIGS. 5A–5D: polystyrene, polypropylene, polyethylene, high density polyethylene, polyvinylchloride, polyacetal, and nylon.

Figure 5A:
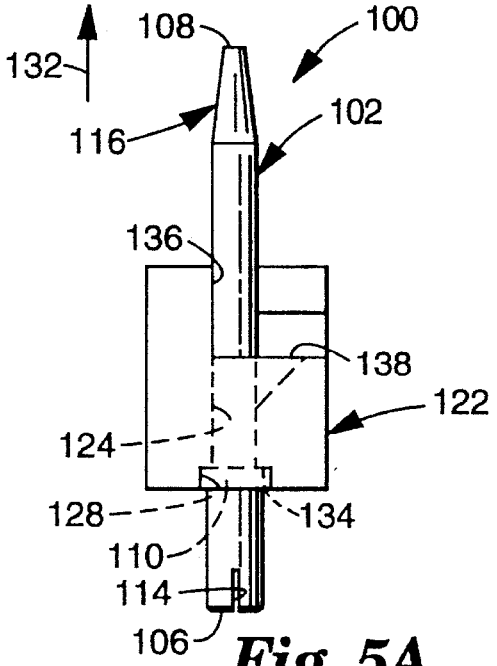
FIG. 5A is a side view of an actuator constructed according to the present invention, with a dispensing tube inserted and in a first position.
Figure 5B:
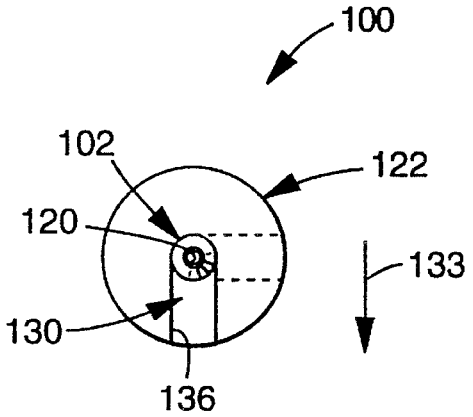
FIG. 5B is a top view of the actuator of FIG. 5A with the dispensing tube in a first position.
Figure 5C:
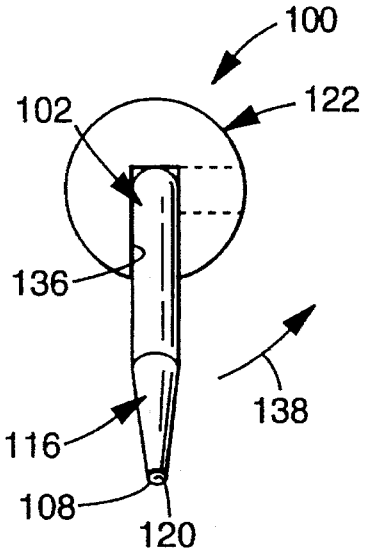
FIG. 5C is a top view of the actuator of FIGS. 5A and 5B, with the dispensing tube deflected to a second position.

Dispensing tube 102 may be inserted in direction 132 through opening 128 through receptacle 124 as shown in FIGS. 5A and 5B. The dispensing tube 102 is positioned within the receptacle of the body 122 by contact between annular ring 110 on the dispensing tube and annular recess 134 formed in the body 122 of the actuator about first opening 128. The dispensing tube 102 is so constructed to enable the portion of the dispensing tube 102 protruding from opening 130 to be deflected in direction 133 as shown in FIG. 5C into slot 136. The deflected portion of the dispensing tube may then be rotated in direction 138 into slot 140, as shown in FIG. 5C, to achieve the position shown in FIGS. 5D and 6. The tube may be secured in place by any suitable means, including but not limited to, mechanical friction, ultrasonic welding, or bonding such as by an adhesive.

The shape and configuration of the receptacle 124 of the actuator body cooperates with the dispensing tube 102 in such a manner as to smoothly deflect the tube from first end 106 to second end 108, and thus smoothly deform the passageway 104 in a curvilinear path. For purposes of this invention, the term "smooth" means to be formed in a manner that is free from irregularities, roughness, indentations, projections, protuberances or any abrupt changes in geometry that provides a location for the accumulation of solidified material. The smooth curvilinear passageway 104 thus eliminates the elbow formed by conventional actuators, wherein the solidified material tends to accumulate.

Figure 5D:
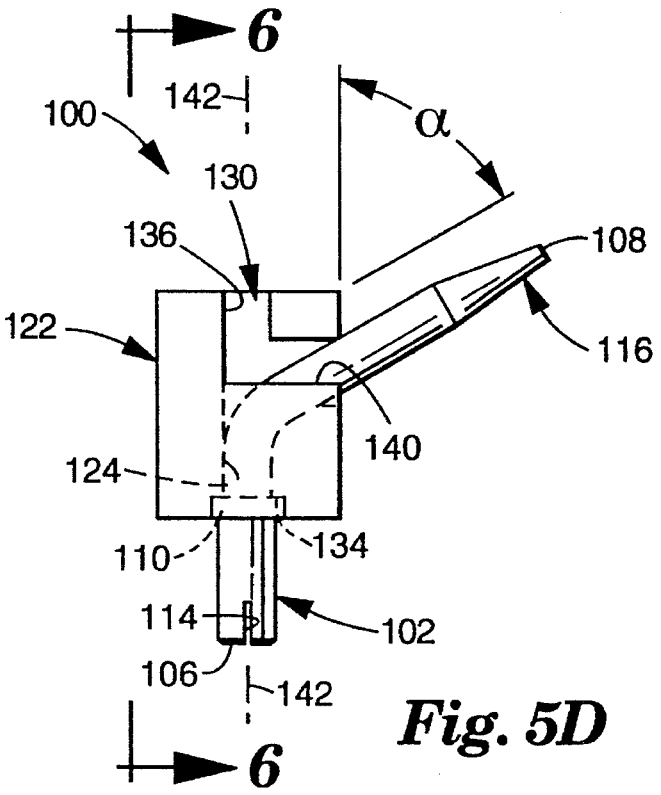
FIG. 5D is a side view of the actuator of FIGS. 5A, 5B, and 5C with the deflected dispensing tube rotated to a third position.
Figure 6:
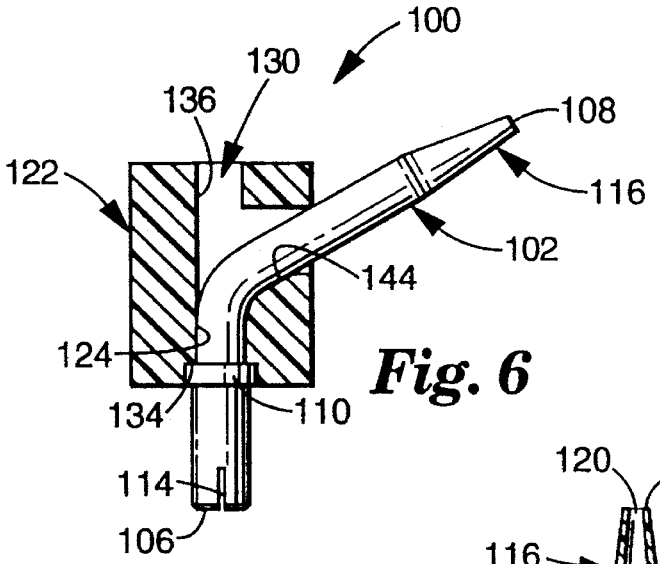
FIG. 6 is a partial cross-sectional view along plane 6—6 of the actuator of FIG. 5D.

In the preferred embodiment of the invention, the dispensing tube extends beyond the actuator body, thus spacing the nozzle portion 116 and orifice 120 therefrom, as shown in FIGS. 5D and 6. By spacing the orifice 120 away from the actuator body 122, the fluid emerging from the orifice is less likely to fall back and accumulate on the exterior of the actuator, or to block the orifice as compared to conventional actuators, such as shown in FIGS. 1–3A. Further, in the preferred embodiment of the invention, the portion of the dispensing tube extending beyond the actuator body, including the nozzle portion, is inclined at an angle α with respect to axis 142. This smooth deflection is facilitated by contact between the deflected portion of the dispensing tube and surface 144 (shown in FIG. 6) within the receptacle.

In this manner, any portion of the fluid that solidifies within the inclined frusto-conical chamber 118 of the nozzle portion will tend to fall to the lower surface of the frusto-conical chamber 118 and drain backward through the dispensing tube 102. This contributes to attenuating the accumulation of the solidified material within the frusto-conical chamber 118 and the potential blockage or restriction of the orifice 120 of the dispensing tube.

In operation, the first end 106 of the dispensing tube 102 forming passageway 104, may be utilized as the stem of the sprayhead assembly and placed in fluid communication with the reservoir 14 of the container through access opening 22, such as through the conventional valve and tube assembly as in FIG. 1. The actuator may then be operated in the manner hereinabove described with respect to FIGS. 1–3A.

Figure 7:
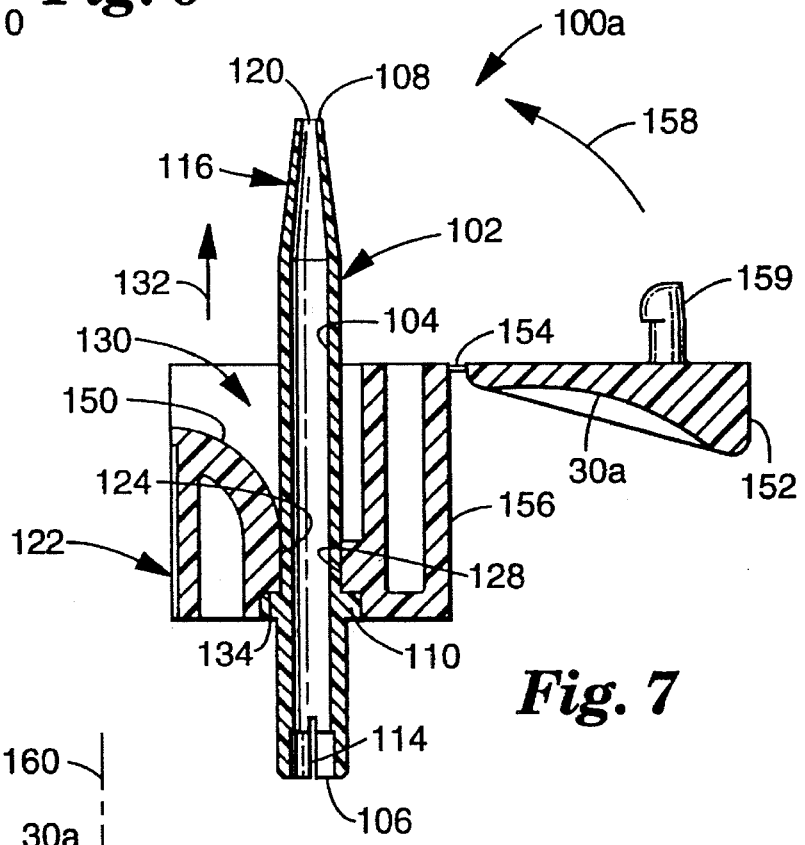
FIG. 7 is a cross-sectional view of an alternate embodiment of the actuator of the present invention with a cap in an open position.
Figure 8:
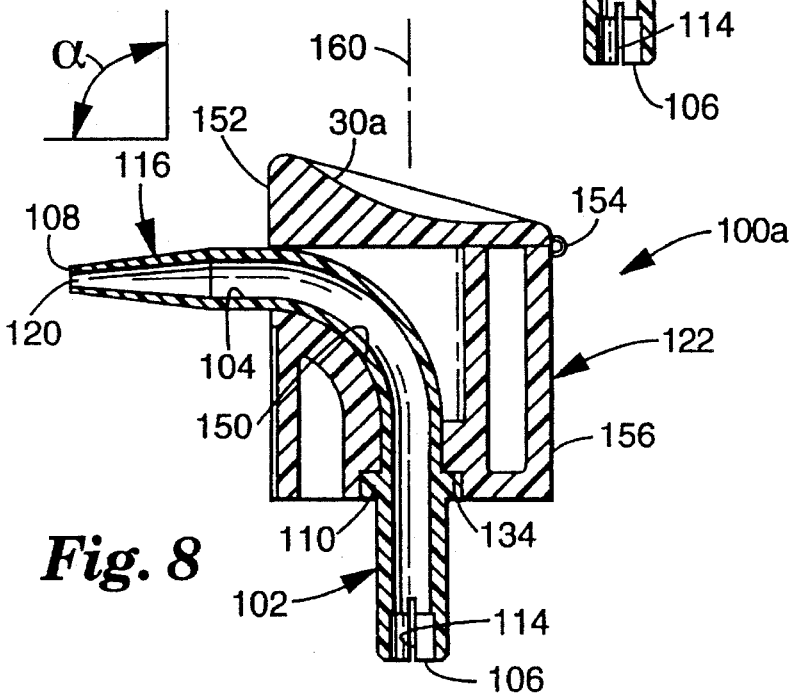
FIG. 8 is a cross-sectional view of the alternate embodiment of the actuator of FIG. 7 with the cap in a closed position.

FIG. 7 illustrates an alternate embodiment 100*a* of the actuator of the present invention. In this embodiment, dispensing tube 102 is inserted in direction 132 through opening 128 into receptacle 124 in the actuator body 122 and projects through opening 130. Receptacle 124 of the actuator includes curvilinear surface 150, corresponding to surface 144 in the embodiment shown in FIG. 6. The actuator body 122 includes a closure or lid 152 hingedly mounted (such as by living hinge 154 in FIG. 7) on the main actuator body portion 156. The "living" hinge enables the actuator lid and main body portion to be molded as a unitary structure, in a manner known in the art. The closure may be rotated in direction 158 to bring the lid 152 in contact with the main actuator body portion 156 as shown in FIG. 8. Contact between the lid 152 .and the dispensing tube 102 deflects a portion of the dispensing tube into conformity with the curvilinear surface 150. Once deflected to the position shown in FIG. 8, the dispensing tube 102 follows a smooth curvilinear path from the first end 106 to the second end 108 and thus attenuates the accumulation of solidified material within the passageway 104 as herein described.

Means are provided to secure the lid in the closed position shown in FIG. 8. In the illustrated embodiment, the securing means include one or more tangs 159 projecting from the lid 152 and preferably integrally molded therewith. When the closure is rotated to the closed position in FIG. 8, the tangs 159 engage an aligned indentation or shoulder (not shown) in the main body portion 156 of the actuator to secure the closure in place. Of course, any suitable arrangement may be provided to secure the lid in the closed position. As in the embodiment shown in FIG. 6, the projecting portion of the dispensing tube 102 is thus inclined at an angle α, (approximately 90°) with respect to axis 160.

Figure 7A:
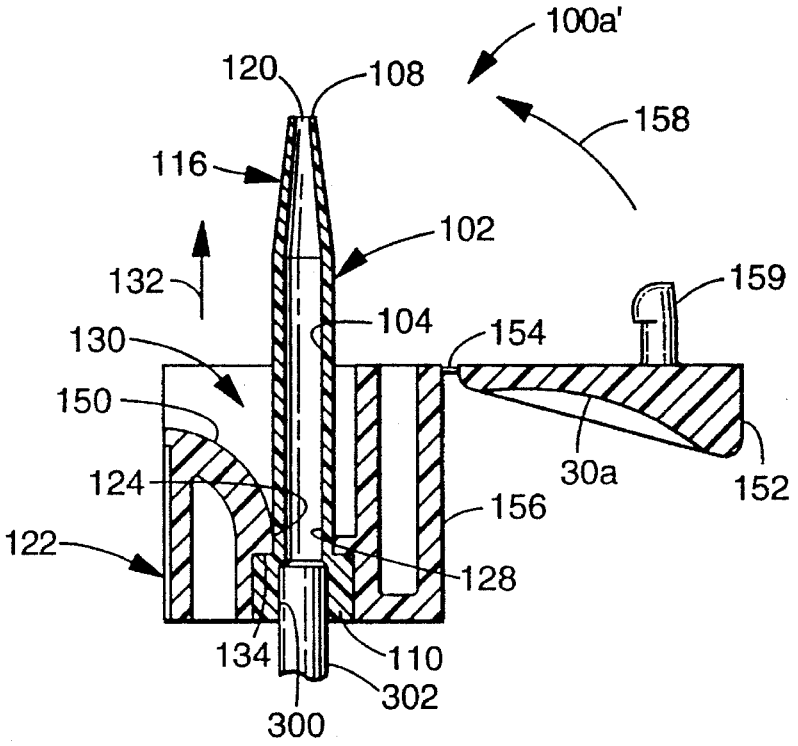
FIG. 7A is a cross-sectional view of the actuator of FIG. 7, modified as a female actuator.

FIG. 7A illustrates a modification 100*a*', of the male actuator embodiment of the present invention shown in FIG. 7, as a female actuator. Cavity 300 is formed in the actuator body communicating with first end 106 of the dispensing tube 102 and with passageway 104. Cavity 300 is adapted to receive in sealing engagement hollow stem 302 extending from a valve (not shown) mounted on a container (similar to the arrangement shown in FIG. 1). In all other respects the embodiment shown in FIG. 7A operates as herein described.

Figure 9:
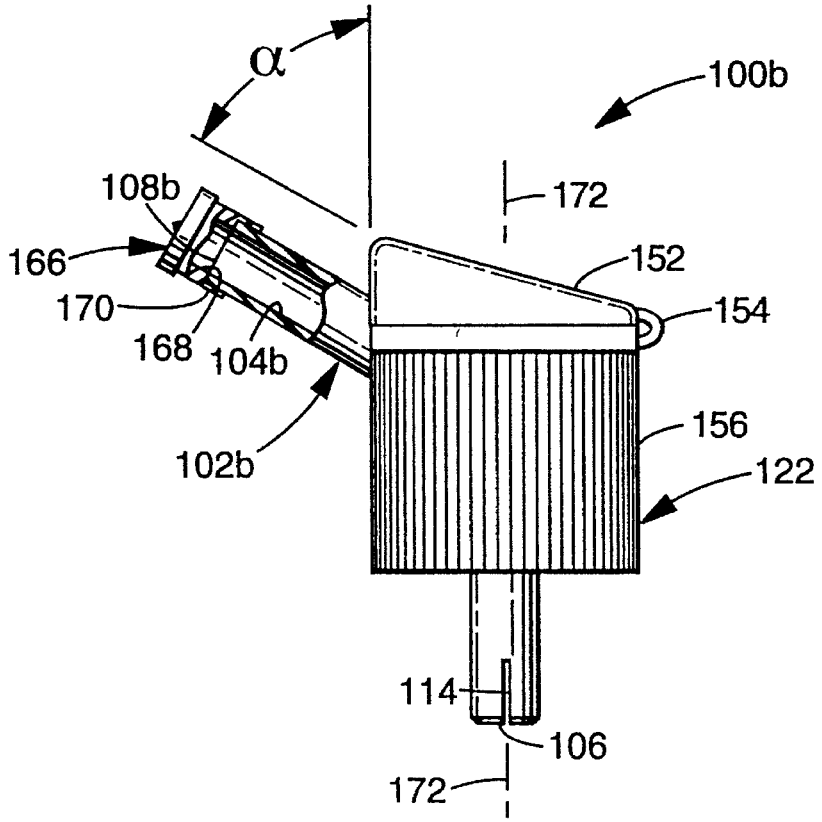
FIG. 9 is a side view of a cap of an alternate embodiment of the sprayhead assembly of the present invention with an insert mounted on the end of the dispensing tube.
Figure 10:
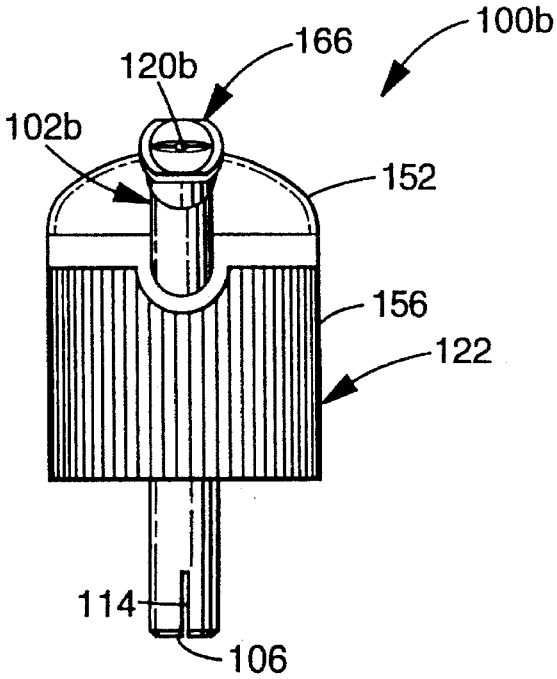
FIG. 10 is a frontal view of the alternate embodiment of the sprayhead assembly of FIG. 9.
Figure 10A:
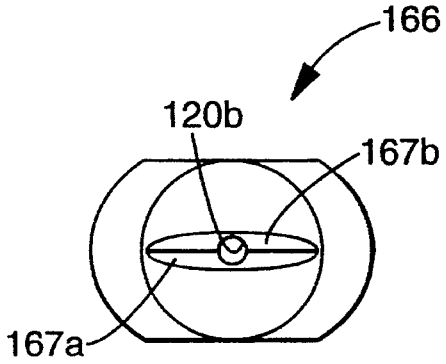
FIG. 10A is a magnified view of the nozzle portion and orifice of FIG. 10.

FIGS. 9, 10 and 10A illustrate another alternate embodiment 100*b* of the present invention. The actuator body 122 is as described with respect to FIGS. 7 and 8. However in place of the nozzle portion having a frustoconical chamber, the passageway 104*b* of the dispensing tube 102*b* terminates at a second end 108 spaced from the actuator body. An insert nozzle 166 is mounted on the end of the dispensing tube 102*b*. The insert is preferably a unitary molded piece, formed such as from polymeric materials including but not limited to, polyethylene, high density polyethylene, polypropylene, polyacetal, polystyrene and nylon, secured on the dispensing tube about the second end of the passageway by any suitable arrangement such as ultrasonic welding, frictional engagement or by the use of an adhesive.

The insert nozzle 166 includes a conduit 168 communicating with the passageway 104*b* extending through dispensing tube 102*b*. The second end 108*b* of the dispensing tube 102*b* is received within an enlarged portion 170 of the conduit so that there is a smooth transition between the passageway 104*b* and conduit 168, to attenuate the accumulation of solidified material therewithin. As shown more particularly in FIG. 10A, the orifice 120*b* of the insert nozzle 166 is generally circular in cross section with laterally spaced deflection surfaces 167*a* and 167*b*. This produces a spray pattern that is more concentrated and flattened than the spray pattern produced by the circular orifice of the embodiments in FIGS. 4–8.

In the illustrated embodiment, the insert nozzle 166 and the portion of the dispensing tube 102*b* protruding from the actuator body are inclined upward from the horizontal at an angle $\alpha$ with respect to axis 172, suitable to drain any solidified material (as defined herein) away from the insert and the orifice to attenuate any blockage of the conduit 168 of the insert nozzle 166 and the projecting position of the dispensing tube 102*b*.

Of course, orifices with any desired size or shape may be provided as part of any embodiment of the present invention to modify and control the spray pattern of the fluid being dispensed in a desired manner. For instance, an orifice having a desired predetermined shape (such as noncircular) may be formed directly on a dispensing tube 102 as shown in FIG. 4.

Figure 11:
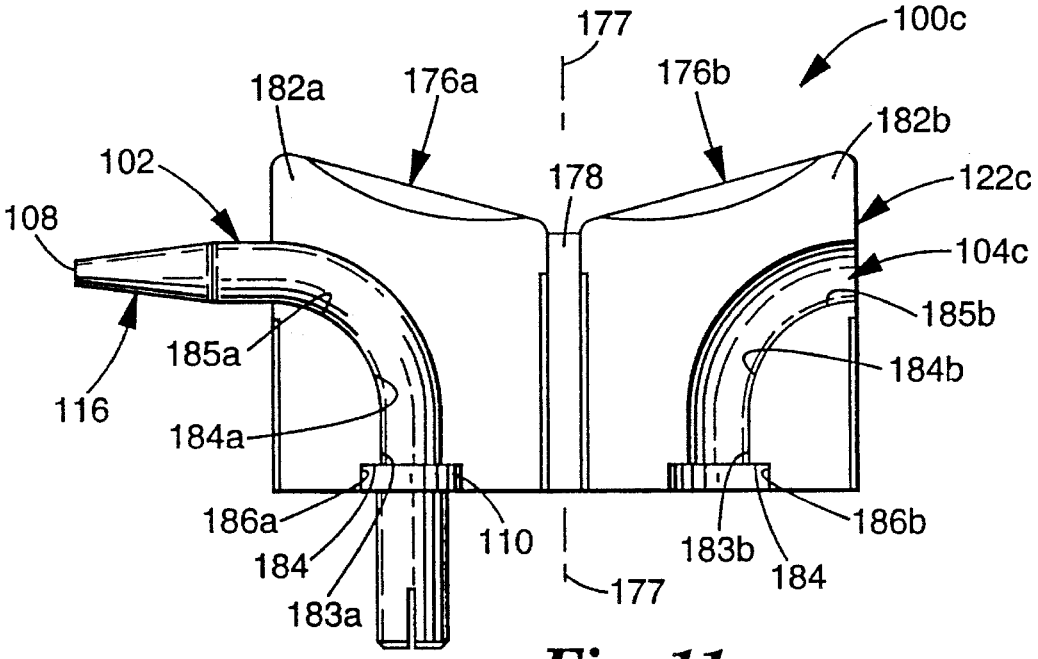
FIG. 11 is a front view of an alternate embodiment of the present invention with bifurcated halves of the actuator body hingedly connected and in an open position.
Figure 12:
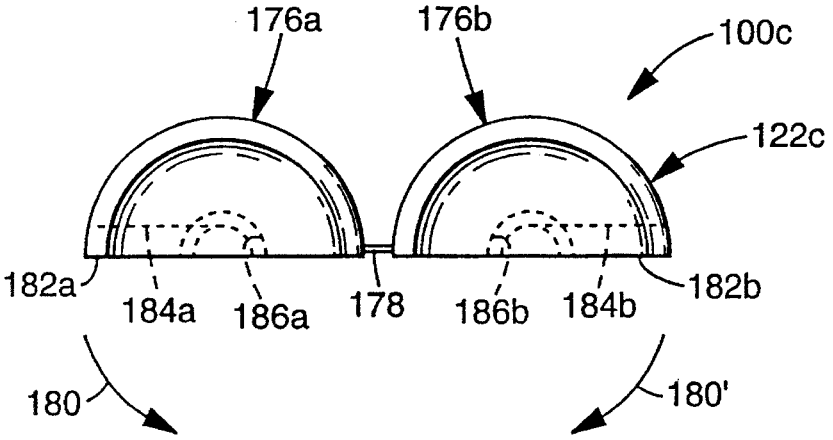
FIG. 12 is a top view of the alternate embodiment of the present invention shown in FIG. 11 without a dispensing tube.
Figure 13:
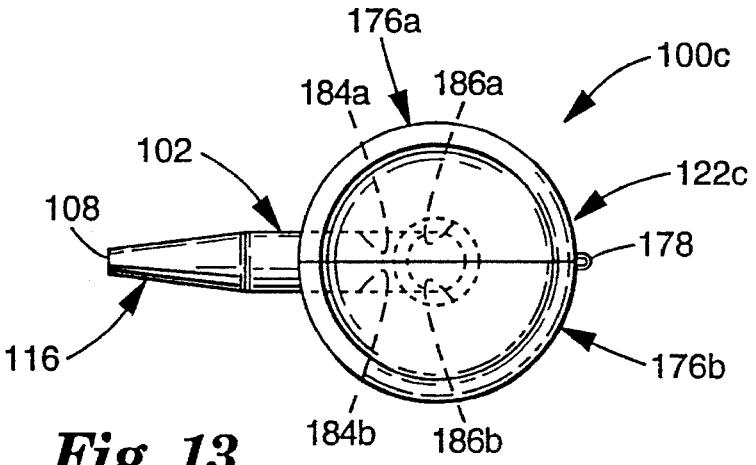
FIG. 13 is a top view of the actuator and dispensing tube of FIG. 11, with the hingedly connected bifurcated halves of the actuator body in a closed position.

FIGS. 11–13 illustrate another alternate embodiment 100*c* of the present invention in which actuator body 122*c* is divided about a plane parallel to axis 177. Preferably, the actuator body is bifurcated into the two segments 176*a* and 176*b*. The segments are rotatively connected along aligned edges parallel to axis 177, such as by living hinge 178. As previously described, the arrangement shown with the living hinge enables the actuator body, including the bifurcated segments, to be molded as a unitary structure in a manner known in the art. The facing surfaces of the bifurcated segments 176*a* and 176*b* may be shifted in opposite rotative directions 180 and 180' between an open position (shown in FIGS. 11 and 12) and a closed position (shown in FIG. 13) with facing surfaces 182*a* and 182*b*, respectively.

The opposing facing surfaces 182*a* and 182*b* of the bifurcated segments 176*a* and 176*b* include aligned grooves 184*a* and 184*b* that cooperate to form passageway 104*c* when the bifurcated segments are brought together in the closed position. Each of the grooves 184*a* and 184*b* include a first end 183*a* and 183*b*, and a second end 185*a* and 185*b*. The grooves extend in a smooth curvilinear manner from their respective first ends to the second ends. Each of the grooves includes portions 186*a* and 186*b* adjacent to the respective first ends thereof that are wider in diameter than the remainder of the grooves 184*a* and 184*b*, so that annular recess 184 (shown in FIG. 11) is formed when the bifurcated segments are in the closed position (similar to annular recess 134 in the embodiment shown in FIGS. 7 and 8).

Thus, a dispensing tube 102 (as in FIG. 4) may be positioned in one of the grooves 184*a*, 184*b* of the bifurcated segments 176*a*, 176*b*, and thus smoothly deflected thereby, with annular ring 110 in contact with one of the enlarged portions 186*a* and 186*b*. The bifurcated segments may then be shifted to the closed position shown in FIG. 13 to enclose and retain the dispensing tube in the smoothly deflected position. The grooves 184*a* and 184*b* have a cross sectional shape suitable for receiving the dispensing tube 102, and preferably the grooves and portions 186*a*, 186*b* are semicylindrical in cross section to receive a tubular dispensing tube. The bifurcated segments 176*a*, 176*b* may be secured in the closed position by any suitable arrangement such as by adhesives, or mechanically such as by tangs, clips, snap closures (not shown), ultrasonic welding, or the like.

Figure 14:
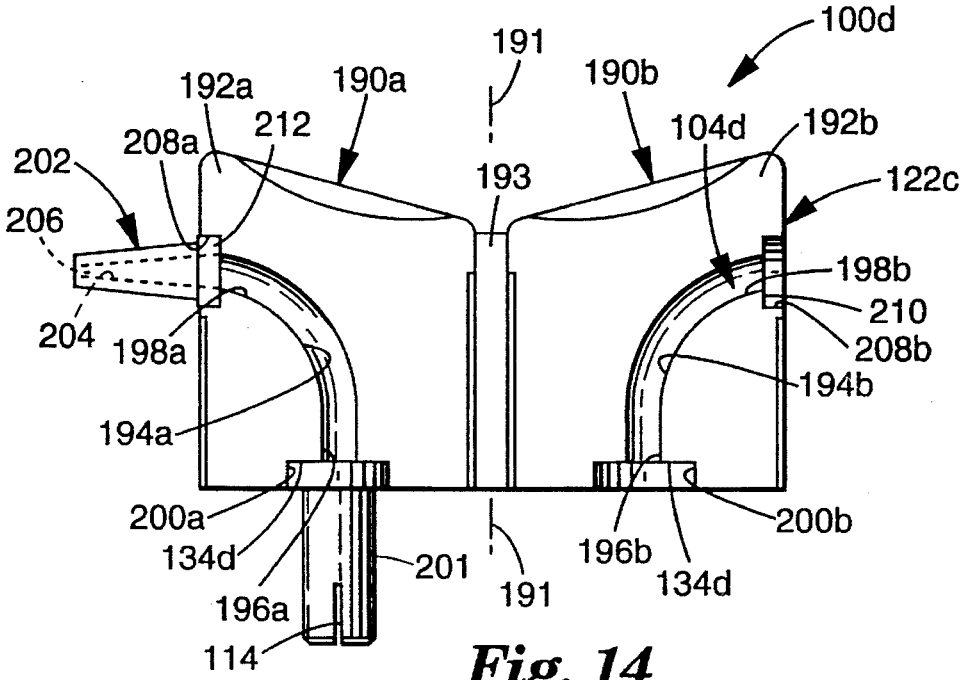
FIG. 14 is a front view of an alternate embodiment of the present invention with bifurcated halves of the actuator body hingedly connected and in an open position.
Figure 15:
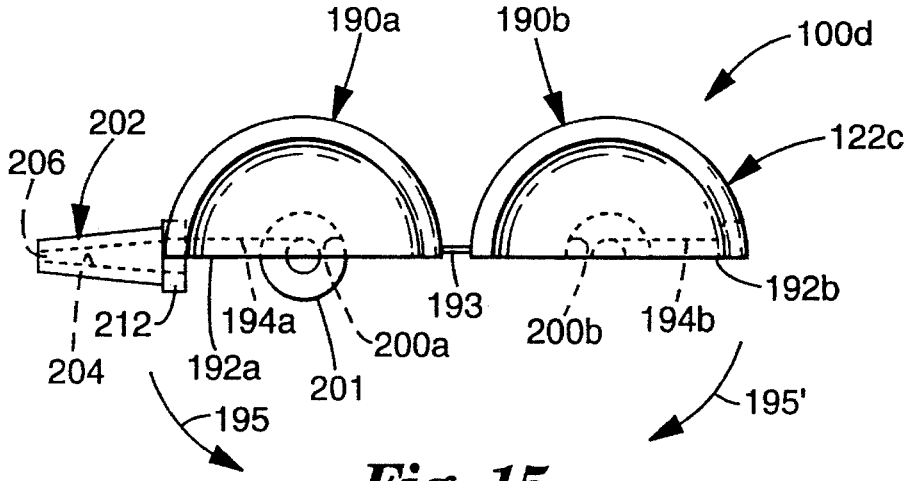
FIG. 15 is a top view of the alternate embodiment of the present invention shown in FIG. 14.
Figure 16:
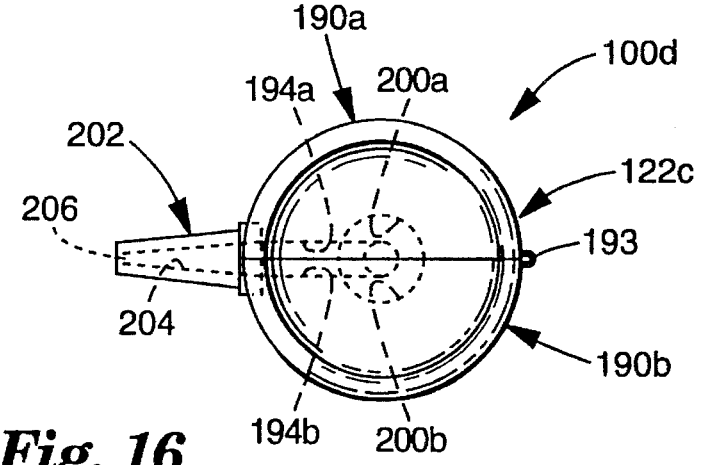
FIG. 16 is a top view of the actuator and dispensing tube of FIG. 14, with the hingedly connected bifurcated halves of the actuator body in a closed position.

FIGS. 14–16 illustrate another alternate embodiment 100*d* of the present invention in which the actuator is constructed in a manner similar to that in FIGS. 11–13. That is, actuator body 122*c* is divided parallel to axis 191 into two segments about a vertical plane. Preferably the plane is a medial plane and the segments are bifurcated, symmetrical halves of the actuator body, as illustrated. The segments 190*a* and 190*b* are rotatively connected along aligned edges parallel to axis 191, such as by living hinge 193. As previously noted, the living hinge enables the entire actuator body, including the bifurcated segments, to be molded as a unitary structure in a manner known in the art. The facing surfaces 192*a*, 192*b* of the bifurcated segments 190*a* and 190*b* may be shifted in opposite rotative directions 195, 195' between an open position (shown in FIGS. 14 and 15) and a closed position (shown in FIG. 16).

In the embodiment shown in FIGS. 14–16, the opposing facing surfaces 192*a*, 192*b* of the bifurcated segments 190*a* and 190*b* include aligned grooves 194*a* and 194*b*, that cooperate to form passageway 104*d* when the bifurcated segments are brought together in the closed position (as shown in FIG. 16). Each of the grooves 194*a* and 194*b* include first ends 196*a*, 196*b* and second ends 198*a*, 198*b*, with the grooves extending in a smooth curvilinear manner from their respective first ends to the second ends. Each of the grooves includes respective portions 200*a* and 200*b* adjacent the first ends thereof, that are larger in diameter than the remainder of the grooves, so that annular recess 134*d* is formed when the bifurcated segments 190*a* and 190*b* are in the closed position (similar to annular recess 134 in the embodiment shown in FIGS. 7 and 8). As in the embodiment in FIGS. 7 and 8, suitable means (not shown) may be provided to secure the bifurcated segments in the closed position including, but not limited to, adhesives, mechanical fasteners (such as snap closures), ultrasonic welding, or the like.

However in the embodiment shown in FIGS. 15 and 16, a dispensing tube is not employed. Rather, the grooves 194*a*, 194*b* directly and cooperatively form a passageway 104*d* when the bifurcated halves 190*a* and 190*b* are shifted to their closed position, as in FIG. 16. Grooves 194*a*, 194*b*, including portions 200*a*, 200*b* have a cross section suitable for smoothly conveying the fluid therethrough, and preferably are semicylindrical to form a cylindrical passageway when the segments 190*a*, 190*b* are in their closed position. A separate tubular stem member 201 may be mounted into the recess 134*d* of the passageway. The stem member 201 includes a passageway (not shown) extending from the passageway of the actuator slot 114 to connect the actuator to a conventional valve and fluid container as previously described. The passageway of the stem member 201 has a diameter matched to the diameter of passageway 104*d* to attenuate the accumulation of solidified material. It is even more preferable to integrally form the stem as part of the actuator body segments, such as by molding, to form the passageway as herein described.

Since a dispensing tube is not provided, a separate nozzle member 202 is provided including a frusto-conical chamber 204 terminating in an orifice 206 for dispensing the fluid therethrough. The second ends 198*a*, 198*b* of the grooves 194*a* and 194*b* each include portions 208*a*, 208*b* of enlarged diameter adjacent thereto. When the bifurcated segments 190*a* and 190*b* are in their closed position, an annular recess 210 is formed. The nozzle member 202 includes a first end 212 having a diameter such that it may be inserted into the annular recess 210 of the passageway 104*d* and retained therein by any suitable means, such as by frictional engagement, adhesives, mechanical fasteners, ultrasonic welding or the like. The inner diameter of the frusto-conical chamber 204 adjacent the first end 212 is sized to closely conform to the inner diameter of the passageway 104*d* and ensure a smooth transition from the passageway to the frusto-conical chamber and attenuate the accumulation of solidified material at the juncture. It has been known in the past to provide a nozzle member having a frusto-conical chamber such as in place of the nozzle portion 38 shown in FIGS. 1–3A. For instance, nozzle model Nos. 251/321 and 251/331 available from Valois S.A. of Le Neubourg, France provide such nozzle portions. However, such conventional nozzle members having frustoconical chambers generally include a "land" or a cylindrical portion extending between the frusto-conical chamber and the orifice. It has been found advantageous in the present invention to eliminate the land and terminate the frusto-conical chamber directly at the orifice.

Of course, an actuator (not shown) similar to that shown in FIGS. 14–16 may be constructed from segments that are not hingedly connected, but rather separate members that are secured together, such as by mechanical fasteners, adhesives, ultrasonic welding or any other suitable arrangements.

Figure 17:
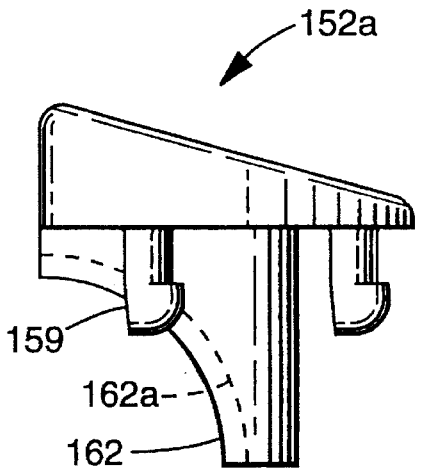
FIG. 17 is a side view of a lid of an alternate embodiment of the present invention.
Figure 18:
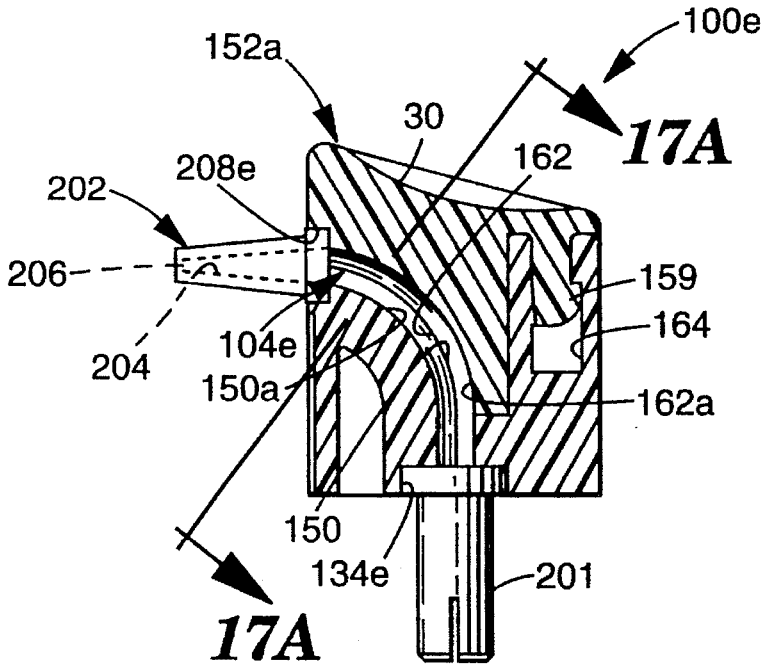
FIG. 18 is a cross sectional side view of the lid of FIG. 17 mounted on a main actuator body to form a passageway.
Figure 17A:
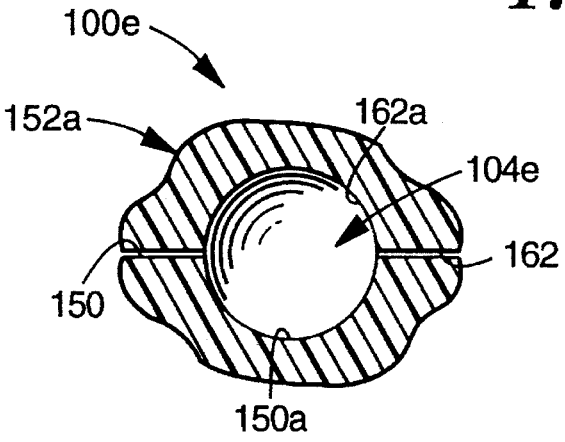
FIG. 17*a* is a magnified cross-sectional view of the passageway extending through the actuator of FIG. 17.

An alternate embodiment 100*e* of the actuator is illustrated in FIGS. 17, 17A and 18, wherein lid or cap 152*a* is provided, but not directly connected to main actuator body portion. Lid 152*a* is provided with a depending curvilinear surface 162 and one or more projecting tangs 159 (two of which are shown in FIG. 17). Lid 152*a* is held in position by engagement of the tangs with aligned receptacles 164 in the main actuator body portion. The curvilinear surface 162 of the lid 152*a* is in contact with curvilinear surface 150 of the main actuator body portion. Aligned grooves 150*a* and 162*a* are formed in the surfaces 150 and 162, respectively. When the surfaces 150 and 162 are brought into fluid tight contact (as in FIG. 17A), the grooves 150*a* and 162*a* cooperate to form a passageway 104*e* extending smoothly through the actuator body from a first end to a second end, as previously described with respect to FIGS. 14–16. As in the embodiment shown in FIGS. 14–16, a stem member 201 is provided for connecting the actuator to a valve (not shown). The stem member is received and mounted in annular recess 134*e* in smooth fluid communication with passageway 104*e*. Similarly a nozzle member 202 is provided, mounted in annular recess 208*e* at the second end of the passageway 104*e*. Preferably however, the stem member and nozzle member may be integrally formed, such as by molding, with the main body portion of the actuator.

Figure 18A:
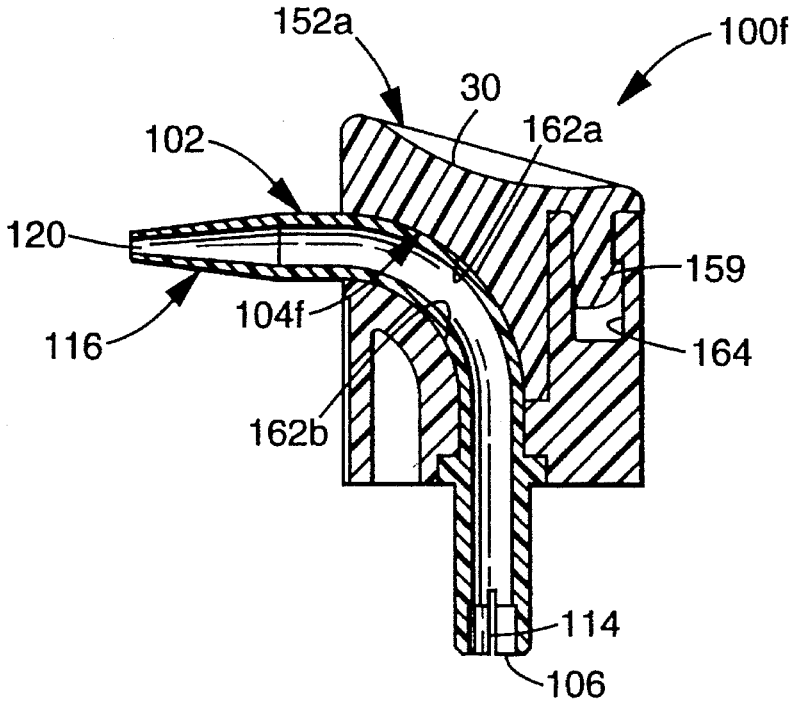
FIG. 18A is a cross sectional view of an alternate embodiment of the actuator of FIG. 18, with a dispensing tube mounted in the passageway.

Another alternate embodiment 100*f* is shown in FIG. 18A, which is substantially identical to the embodiment shown in FIG. 18. However in the embodiment shown in FIG. 18A, a dispensing tube 102 has been located within the passageway 104*f* formed by the cap 152*a* and main body portion.

Figure 19:
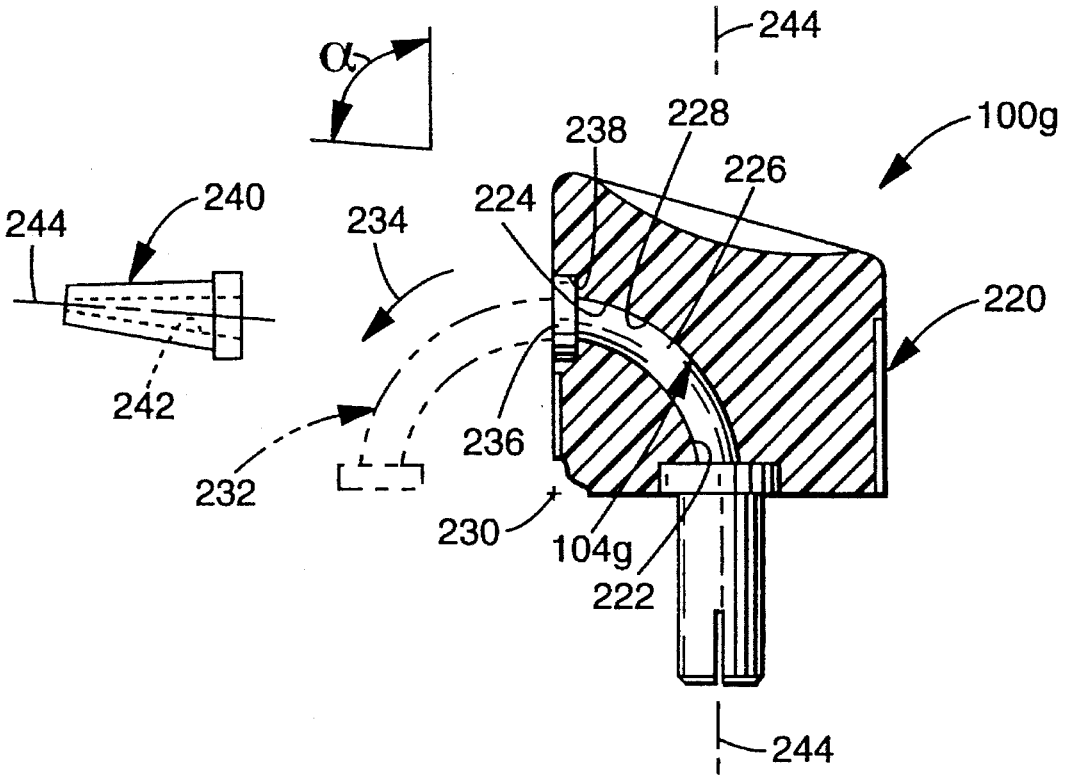
FIG. 19 is a cross sectional view of an alternate embodiment of the present invention with the actuator formed from a unitary molded body with passageway.

Another alternate embodiment 100 g of the present invention is illustrated in FIG. 19. In this embodiment, the actuator is formed from a unitary molded body 220, preferably molded from a polymeric material, as previously described herein. As in the embodiments shown in FIGS. 14–16, a passageway 104*g* is defined within the actuator body, extending from a first end 222 to a second end 224, rather than by a dispensing tube. One method for forming the passageway 104*g* in a unitary molded body includes providing an arcuate pin 226 in the mold cavity (as at 228). The arcuate pin 226 is rotatable about a center point 230 between a first rotational position (as shown) and a second position (as at 232). The pin 226 is located in the first position when the actuator body is molded. After molding, the pin 226 is rotated within the mold cavity in rotational direction 234 (in a manner known in the art) to the second position, enabling the actuator body to be removed from the mold cavity and forming the passageway. Preferably, the arcuate 226 pin includes a head portion 236 at one end, so that an annular recess 238 is formed at the second end 224 of the passageway. The first end 222 of the passageway may be connected to a stem (not shown) in any suitable manner, previously described herein. Preferably, the stem is integrally molded with the actuator body.

As in the embodiment shown in FIGS. 14–16, a separate nozzle member 240 is provided having a frustoconical chamber 242 formed therein and adapted for mounting in the annular recess 238 with a smooth transition between the passageway 104*g* and the frusto-conical chamber 242.

Of course, alternate methods for constructing the actuator body from a unitary molded piece may be employed, such to provide a "sacrificial" mold. That is, a mold is provided with a curvilinear portion occupying the space for the passageway. The actuator body is then molded about the "sacrificial" passageway portion, and the unitary molded actuator body removed from the mold. The "sacrificial" portion is then destroyed to remove it from the actuator body, leaving the passageway free to convey fluid as described elsewhere herein. The "sacrificial" portion may be destroyed by dissolving it in a suitable solvent, melting it, ultrasonically pulverizing it, or any other suitable arrangement.

In the preferred embodiments of the invention that incorporate a separate nozzle member, the nozzle member is constructed and mounted in the annular recess so that the frusto-conical chamber is inclined at an angle e less than 90° with respect to the axis 244. In this manner, any material that solidifies within the frusto-conical chamber 242 tends to be deposited on the "floor" of the chamber and then drains backward through the passageway and back into the reservoir through the actuator. Conventional fluid dispensers have dispensing nozzles that are inclined with respect to the container. Such constructions have been provided to direct the nozzle at a convenient angle for dispensing the fluid from the container but have not addressed the problem of accumulation of solidified material within the nozzle portion or the passageway.

Figure 20:
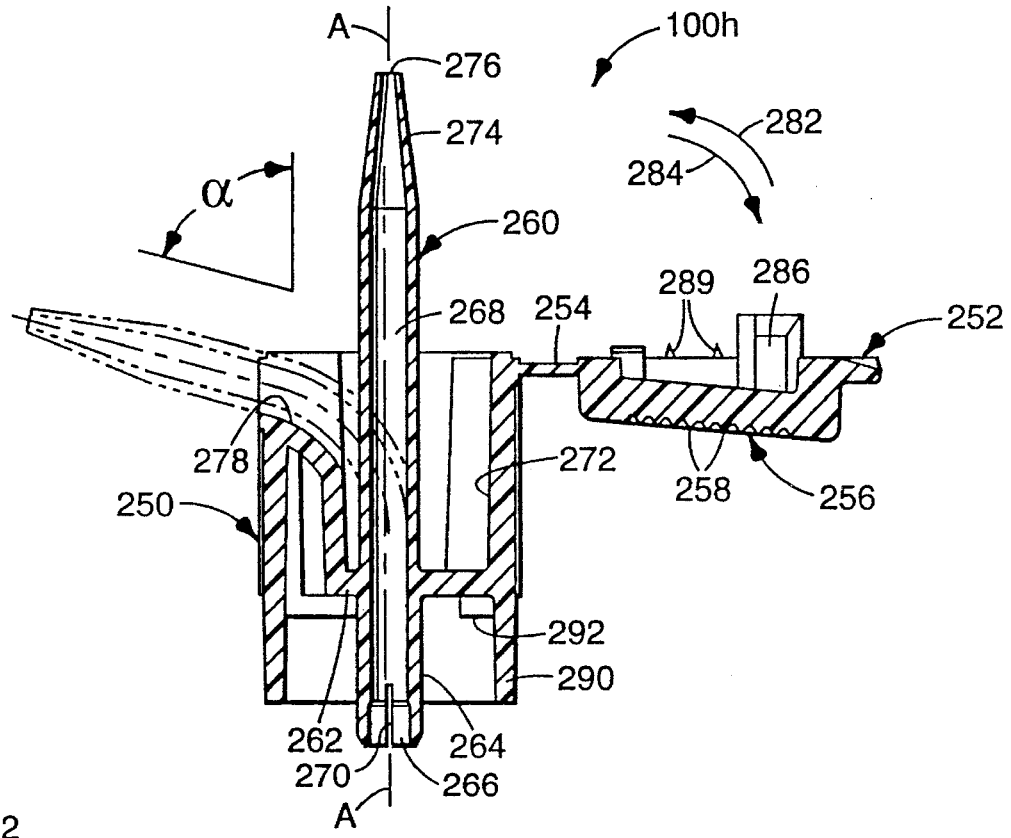
FIG. 20 is a cross sectional view of yet another alternate embodiment of the present invention in which the dispensing tube and the actuator body are formed in a unitary molded structure.
Figure 21A:
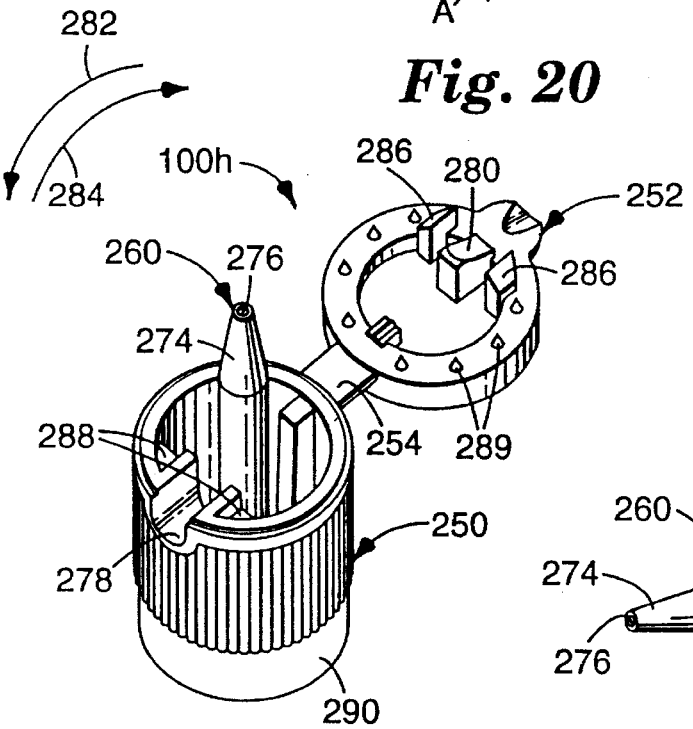
FIG. 21A is an isometric view of the actuator of FIG. 20, with the actuator cap in an open position and the dispensing tube undeflected.
Figure 21B:
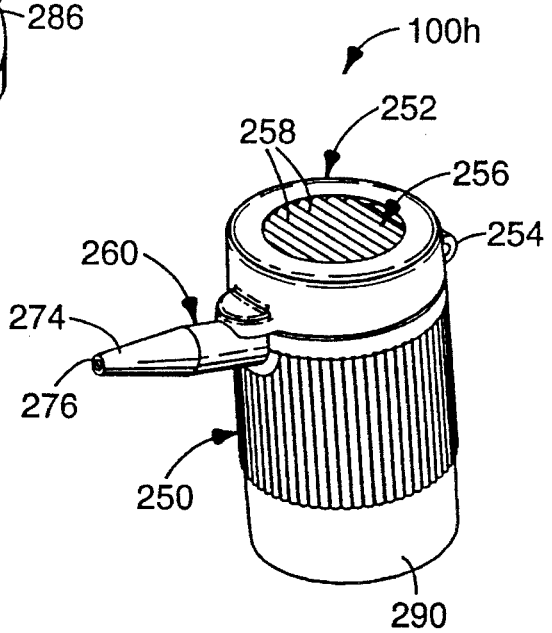
FIG. 21B is an isometric view of the actuator of FIG. 20, with the actuator cap in a closed position and the dispensing tube deflected.

In FIGS. 20, 21A and 21B, there is shown another alternate embodiment 100*h* of the present invention. In this embodiment, the dispensing tube and the actuator body are formed from a unitary structure, preferably by a molded polymeric material. Any desired molding process may be employed, such as injection molding. Preferably, the embodiment 100*h* is molded of high density polyethylene, but any suitable material, such as the materials previously discussed herein may be employed, including, but not limited to: polyethylene, polystyrene, polyacrylate, high density polyethylene, polytetrafluoroethylene and nylon.

As shown, the unitary body includes an actuator body 250 and a cap 252 connected to the actuator body, such as by living hinge 254. The top of the cap 252 includes a contact portion 256 adapted for manual engagement to depress the actuator, as previously described. In the illustrated embodiment, the contact surface 256 includes a plurality of parallel ribs 258.

A dispensing tube portion 260 is integrally formed and connected to the actuator body portion 250 by annular flange 262. One end of the dispensing tube portion 260 forms stem 264 for connection to a container and hereinelsewhere described. Opening 266 at the end of the stem communicates with passageway 268 extending through the dispensing tube portion. One or more axially extending slots or slits 270 are formed in the stem and communicate with the opening 266 to regulate the flow of fluid through the passageway 268, previously discussed herein.

The dispensing tube portion 260 extends from annular flange 262 oppositely from stem 264 through cavity 272 in the actuator body. The dispensing tube portion terminates in nozzle 274, which in the illustrated embodiment, is frusto-conical. Passageway 268 terminates in orifice 276 at the tip of the nozzle 274, for directing the flow of fluid from the dispensing tube portion.

As in the embodiments of the present invention previously described herein having a separate dispensing tube, the dispensing tube portion is so constructed as to be smoothly deflectable from the upright, undeflected position shown in FIG. 21A, to the deflected position shown in FIG. 21B. The deflection is accomplished with curvilinear deflecting surface 278 formed on the actuator body portion in the cavity 272. Aligned curvilinear deflecting surface 280 is formed in the facing surface of the cap portion 252. When the cap portion is rotated in direction 282 about hinge 254 to a "closed" position as shown in FIG. 21B, the deflecting surfaces 278, 280 encounter the dispensing tube portion and smoothly deflect it so that the portion protruding from the actuator body is preferably inclined at an angle $\alpha$, with respect to an axis "A" extending though the stem portion of the dispensing tube. The cap portion may be similarly rotated back in direction 284 to the "open" position shown in FIGS. 20 and 21A.

Means are provided to secure the cap portion in the closed position as shown in FIG. 21B. In the illustrated embodiment, the securing means takes the form of a pair of tangs 286 projecting from the facing surface of the cap portion, preferably on either side of the deflecting surface 280. A pair of aligned shoulders 288 are formed in the actuator body, so that when the cap portion is rotated to the closed position, the tangs are interengaged with the shoulders to secure the cap portion in the closed position. The tangs may be forcibly disengaged from the shoulders to enable the cap portion to be rotated back to the open position, if desired. Of course, any other suitable arrangement, such as adhesives, may be employed to secure the cap portion in the closed position, as may be found advantageous in a particular application. Alternatively, if it is found desirable to ultrasonically weld the cap portion to the body portion in the closed position, one or more protrusions or ultrasonic energy directors 289 may be formed in either or both of the facing surfaces of the cap portion and body portion, that are brought into contact with each other when the cap portion is in the closed position. The energy directors facilitate the welding process in a manner known in the art. After ultrasonic welding, the cap portion may not be shifted to the open position, without damage to the actuator.

The illustrated embodiment 100*h* also includes a skirt 290 depending from the actuator body portion. The skirt facilitates guiding the actuator body with respect to a container (not shown) containing a fluid to be dispensed as the actuator is shifted axially. A stop 292 is formed on the actuator body to contact a portion of the container (not shown) to limit downward axial travel of the actuator, thereby limiting transverse movement of the actuator and enabling stability of the actuator and uniform activation during use.

It will be appreciated that in all other respects, that embodiment 100*h* functions as hereinelsewhere described.

Figure 22:
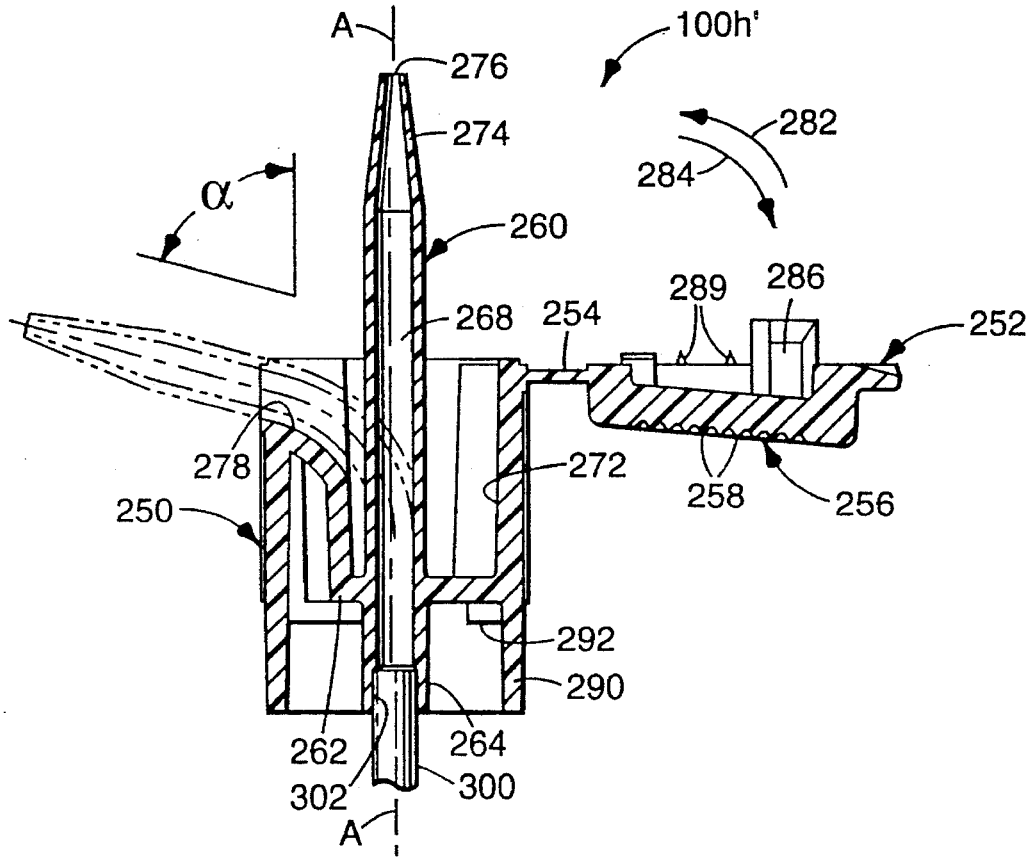
FIG. 22 is a cross-sectional view of the actuator of FIG. 20, modified as a female actuator.

FIG. 22 illustrates a modification 100*h*' of the male actuator of the male actuator embodiment of the present invention shown in FIG. 21, as a female actuator. Cavity 300 is formed communicating with opening 266 of passageway 268. Cavity 300 is adapted to relieve in sealing engagement hollow stem 302 extending from a valve (not shown) mounted on a container (similar to the arrangement shown in FIG. 1 ). In all other respects, the embodiment shown in FIG. 22 operates as herein described.

In one preferred embodiment of the invention, the nozzle member is constructed of a material (such as polyethylene) that is resilient and has a relatively thin wall. This enables the nozzle to "spit" out globules of fluid having relatively larger diameter, thereby having less tendency to clog.

Spray Width

A container of the material to be tested was secured with a clamp in a vertical position about 20 cm (8 inches) from a drum 41 cm (16 inches) high by 38 cm (15 inches) diameter rotating at 18 RPM, on which a transparent film was attached. Using hand pressure, the container actuator was depressed for about 2 seconds depositing the material on the transparent film. The film was removed from the drum and two measurements of the major dimensions were taken and the average was determined to be the "Spray Width". A desired result is an average spray width of 5.0–10.16 cm (2–4 inches).

Delivery Rate

A container of the material to be tested was first weighed (initial weight) and the contents expelled by depressing the spray head for 10 seconds. The container was then weighed again (final weight). The difference between the initial weight and the final weight multiplied by 6 gave the "Delivery Rate" in grams/minute.

Uniformity of Particles/Spray

The material to be tested was sprayed on a substrate. While the material was being sprayed, the sprayed material was visually inspected for uniformity of particles. If at least 90 percent of the spray was of similar size, the spray was observed to be uniform.

Sprayability

A container of the material to be tested was conditioned at room temperature (20° C.) for 24 hours. The contents were then expelled onto a horizontal surface while holding the container at about a 45° angle at a distance of about 15–20 cm (6–8 inches) from the horizontal surface while moving at a rate of about 0.45 m (1.5 ft)/second. Spraying was conducted three (3) times per day, five (5) days per week until the contents of the can were evacuated or could no longer be sprayed. Each test was conducted for a 10 second duration. While spraying, observation was made for the occurrence of clogging of the spray nozzle, especially at the outset, and for spitting (large, nonuniform droplets). No spitting or clogging was an acceptable result.

In the following spray formulations, all parts are by weight unless otherwise specified.

Aerosol Formula A—Water Based Formulation

A premix was prepared by blending together 100 parts styrene butadiene rubber (SBR) polymer dispersion, 49% solids (BUTOFAN NS-144, available from BASF Corp., Parsippany, N.J.); 100 parts resin emulsion, 55% solids (FORAL 85-55WKX, available from Hercules, Inc., Wilmington, Del.); and 10 parts antifoam agent (SILWET L-7500, available from Union Carbide Corp., Danbury, Conn.). 70 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 30 parts of 1,1-difluoroethane propellent (DYMEL 152a, available from E. I. du Pont de Nemours and Co., Wilmington, Del.) were inserted under about 828 kPa (120 psig) up to the desired weight percent. The actuator was added and the can shaken to mix ingredients. Aerosol A thus prepared had a solids content of 38% by weight and a pressure of 586 kPa (85 psig).

Aerosol Formula B—Hydrocarbon Solvent Based Formulation

A premix was prepared by blending together 100 parts crosslinked SBR polymer (POLYSAR S 1018, available from Polysar Ltd, Sarnia, Ontario, Canada), having a gel content of about 81%, containing approximately 23.5% bound styrene, (milled 4 passes through a two roll mill); 60 parts terpene phenolic resin (SCHENECTADY SP-560, available from Schenectady Chemicals, Inc., Rotterdam Junction, N.Y.); 90 parts pentaerythritol ester of hydrogenated resin (FORAL 105, available from Hercules, Inc., Wilmington, Del.); and 465 parts of a mixture of hexane/cyclohexane as solvents. 340 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 150 parts of a mixture isobutane/propane/dimethyl ether propellent were inserted under about 828 kPa (120 psig) up to the desired weight percent. The actuator was added and the can shaken to mix ingredients. Aerosol B thus prepared had a solids content of 24% by weight and a pressure of 414 kPa (60 psig).

Aerosol Formula C—Hydrocarbon Solvent Based Formulation

A premix was prepared by blending together 100 parts of a copolymer of 95/5 isooctylacrylate/acrylic acid, prepared according to U.S. Pat. No. 3,578,622 (Brown et al., Example 1); 75 parts pentaerythritol ester of hydrogenated resin (FORAL 105, available from Hercules, Inc., Wilmington, Del.); and 1280 parts of 1,1,1-trichloroethane as solvent. 250 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 150 parts of a mixture isobutane/propane propellent were inserted under about 828 kPa (120 psig) up to the desired weight percent. The actuator was added and the can shaken to mix ingredients. Aerosol C thus prepared had a solids content of 7.5% by weight and a pressure of 310 kPa (45 psig).

EXAMPLES OF ACTUATORS

Examples of actuators corresponding to the embodiment 100*a* shown in FIGS. 7 and 8, and 100*h* shown in FIGS. 20, 21A and 21B were constructed and tested according to the test methods described above.

Inventive Example 1

In Example 1 the dispensing tube had an overall length of 3.454 cm (1.360 inches), a slot width between 0.030 and 0.033 cm (0.012–0.013 inches), and a slot height of 0.272 cm (0.107 inches). The dispensing tube had a nominal inner diameter of 0.165 cm (0.065 inches). The frusto-conical chamber of the nozzle portion had a nominal taper of 0.056 RAD. The orifice had a diameter of 0.064 cm (0.025 inches).

Inventive Example 2

All dimensions were as set out in Example 1, except the slot width which was between 0.028 and 0.030 cm (0.011 and 0.012 inches), and the slot height which was 0.267 cm (0.105 inches).

Inventive Example 3

An actuator corresponding to the embodiment 100*h* shown in FIGS. 20, 21A and 21B was constructed of high density polyethylene (Type #9018 available from Chevron Chemical Company, Houston, Tex.) and tested according to the test methods described above.

All dimensions were as set out in Example 1, except the slot height was 0.298 cm (0.1175 inches), and both the interior surface of the dispensing tube and the exterior surface of the nozzle portion were processed to a finish of SPI-SPE#2.

Conventional Example 1

A 152-20-18-10 actuator having a slot width of 0.051 cm (0.020 inches), available from Newman-Green, Addison, Ill., was used.

Conventional Example 2

An 820-20-23N Seaquist Brand actuator having a slot width of 0.051 cm (0.020 inches), available from Seaquist Dispensing, Division of Aptar Group, Cary, Ill., was used.

Conventional Example 3

A 120-24-18-10 actuator having a slot width of 0.051 cm (0.020 inches) available from Lindal Valve, GmbH, Germany, was used.

Formulations tested, actuators used, and test results are given in Table 1 below.

TABLE 1

| Actuator | Aerosol Formula | Delivery Rate (g/min) | Spray Width (cm) | Uniformity | Sprayability |
|---|---|---|---|---|---|
| Inv. Ex. 1 | A | 86 | 9.65 | Uniform | Acceptable |
| Inv. Ex. 1 | A | 90 | 7.62 | Uniform | Acceptable |
| Inv. Ex. 2 | A | 45–50 | 6.35 | Uniform | Acceptable |
| Inv. Ex. 1 | B | 72 | 6.35 | Uniform | Acceptable |
| Inv. Ex. 1 | C | 52 | 7.62 | Uniform | Acceptable |
| Inv. Ex. 3 | A | 93 | 9.52 | Uniform | Acceptable |
| Conv. Ex. 1 | A | 67 | 6.35 | Uniform | Unacceptable |
| Conv. Ex. 2 | B | 77 | 5.08 | Uniform | Unacceptable |
| Conv. Ex. 3 | C | 62 | 4.83 | Nonuniform | Unacceptable |

It can be seen from the above data that by reducing the slot width and length of the actuator, the delivery rate can be reduced. It can also be seen from the above data that the present invention allows for acceptable sprayability and particle uniformity of a water-based adhesive formulation, while conventional actuators do not.

In regard to all of the embodiments of the present invention described hereinabove, it is believed that the preferred range of inclination ($\alpha$) is between 0°–20°, for optimal operation.

The present invention has now been described with reference to multiple embodiments thereof. It will be apparent to those skilled in the art that many changes can be made in the embodiments described without departing from the scope of the present invention. For instance, it is within the spirit and scope of the invention to provide an actuator that is rotated between open and closed positions, rather than axially shifted as illustrated herein. Further, the actuator, dispensing tube and other components of the present invention may be constructed from other materials, such as metallic materials including, but not limited to, aluminum and a copper-beryllium alloy; ceramic materials, and thermoset resins, as may be found advantageous. Such materials may be useful in dispensing fluids that have been heated to an elevated temperature. Thus, the scope of the present invention should not be limited to the structures described in this application, but only by structures described by the language of the claims and the equivalents of those structures.

What is claimed:

1. An actuator for use with a dispenser for a fluid, comprising:

(a) an actuator body:

(b) a passageway smoothly extending in a smooth curvilinear manner through said actuator body from an inlet end to an outlet end, for conveying the fluid from said inlet end to said outlet end thereof while attenuating accumulation of solidified material from the fluid within said passageway and on said actuator body;

(c) a dispensing tube having a inlet end and a outlet end and defining said passageway extending between said inlet end and said outlet end of said dispensing tube;

(d) means for mounting said dispensing tube on said actuator body; and (e) means for deflecting a portion of said dispensing tube while received mounted on said actuator body, wherein said passageway extends smoothly in a curvilinear manner between said inlet end and said outlet end to attenuate the accumulation of solidified material from the fluid during dispensing of the fluid.

2. The actuator of claim 1, wherein said actuator body includes an axis and a portion of said passageway adjacent said inlet end of said dispensing tube is generally parallel with said axis of said actuator body, and wherein a portion of said dispensing tube adjacent said outlet end of said dispensing tube includes an axis that is inclined with respect to said axis of said actuator body, to induce solidified material from the fluid within said inclined portion of said dispensing tube to drain towards said inlet end of said passageway.

3. The actuator of claim 1, wherein said dispensing tube includes an annular ring, and said actuator body includes an annular recess for receiving said annular ring when said dispensing tube is inserted into said receptacle of said actuator body, the contact between said annular ring and said annular recess locating said dispensing tube with respect to said actuator body.

4. The actuator of claim 1, further including a nozzle portion mounted on said outlet end of said dispensing tube, said nozzle portion having a conduit extending therethrough from an inlet end in smooth fluid communication with said outlet end of said dispensing tube and an outlet end forming an orifice for directing the dispensing of the fluid therethrough.

5. The actuator of claim 1, further including means for connecting said inlet end of said dispensing tube to a source of the fluid, and means for propelling the fluid through the actuator.

6. The actuator of claim 1, wherein said passageway of said dispensing tube includes a nozzle portion at said outlet end having a frusto-conical chamber terminating at an orifice, for smoothly conveying the fluid though said dispensing tube exteriorly of the actuator.

7. The actuator of claim 1, wherein said means for mounting said dispensing tube on said actuator tube includes a receptacle formed in said actuator body, said receptacle having a first opening through which said outlet end of said dispensing tube may be inserted, and a second opening through which said outlet end of said dispensing tube projects from said actuator body.

8. The actuator of claim 7 wherein said actuator body includes:

(a) an axis;

(b) said first opening and said second opening of said receptacle being axially aligned with respect to each other;

and wherein said means for deflecting said dispensing tube includes (c) a first, axially aligned slot formed in said actuator body and communicating with said receptacle and said second opening of said receptacle; and (d) a second, circumferential slot communicating with said first slot and said receptacle;

(e) wherein a portion of said dispensing tube adjacent said projecting outlet end thereof may be axially deflected through said first slot and then radially deflected through said second slot, whereby said passageway of said dispensing tube extends smoothly from said inlet end to said outlet end to attenuate the accumulation of solidified material from the fluid during dispensing of the fluid.

9. The actuator of claim 7, wherein said actuator body includes a main body portion and a cap hingedly connected to said main body portion, said cap being shiftable between a first, open position and a second, closed position and including means to secure said cap in said second, closed position, and wherein when said cap is being shifted from said first, open position to its second, closed position, said cap encounters said projecting portion of said dispensing tube and deflects said projecting portion of said dispensing tube with said passageway of said dispensing tube extending smoothly in a curvilinear manner from said inlet end to said outlet end.

10. The actuator of claim 9, further including a smooth, curvilinear surface formed in said receptacle of said actuator body, wherein said dispensing tube is urged to conform against said smooth curvilinear surface within said receptacle when said cap is in said second, closed position.

11. The actuator of claim 9, further including a smooth, curvilinear surface formed in said receptacle in said actuator main body portion, wherein said dispensing tube is urged to conform against said smooth curvilinear surface within said receptacle when said cap is in said second, closed position with said passageway of dispensing tube portion extending smoothly in a curvilinear manner from said inlet end to said outlet end.

12. The actuator of claim 11, further including a smooth, curvilinear surface formed in said cap, wherein said dispensing tube is urged to conform against said smooth curvilinear surface of said cap when said cap is in said second, closed position with said passageway of dispensing tube portion extending smoothly in a curvilinear manner from saidinlet end to said outlet end.

13. The actuator of claim 9, further including a smooth, curvilinear surface formed in said cap, wherein said dispensing tube is urged to conform against said smooth curvilinear surface of said cap when said cap is in said second, closed position with said passageway of dispensing tube portion extending smoothly in a curvilinear manner from said inlet end to said outlet end.

14. The actuator of claim 1, wherein said actuator body defines an axis and said actuator body is divided into two segments along a plane parallel to said axis, each segment having a facing surface, with an aligned groove formed in each facing surface and extending from an inlet end to an outlet end, said grooves each for receipt of said dispensing tube with said outlet end of said dispensing tube projecting beyond said actuator body, and said dispensing tube being smoothly deflected in a curvilinear manner from said inlet end to said outlet end of said receiving groove, and wherein said facing surfaces may be brought together with said grooves aligned to cooperatively secure said dispensing tube in said smoothly deflected position with said passageway of dispensing tube extending smoothly from said inlet end to said outlet end.

15. The actuator of claim 14, wherein said divided segments of said actuator body are hingedly connected parallel to said axis, whereby said divided segments may be rotated between a first, open position wherein said dispensing tube is received within one of said grooves on one of said facing surfaces, to a second, closed position to secure said dispensing tube in said smoothly deflected position between said grooves with said passageway of dispensing tube extending smoothly in a curvilinear manner from said inlet end to said outlet end.

16. The actuator of claim 1, further including a stem member having a conduit extending therethrough, wherein said stem member may be mounted on said actuator body in communication with said first opening of said passageway to convey the fluid into said passageway.

17. The actuator of claim 1, further including an insert nozzle mounted on said second end of said dispensing tube, said insert nozzle including a conduit extending from an inlet end in smooth fluid communication with said passageway of said dispensing tube, said conduit extending to an orifice for directing the dispensing of the fluid.

18. The actuator of claim 17, further including one or more deflecting surfaces formed in said insert nozzle about said orifice for directing the dispensing of fluid.

19. The actuator of claim 1, wherein the actuator is a male actuator.

20. The actuator of claim 1, wherein the actuator is a female actuator.

21. An actuator for use with a dispenser for a fluid, comprising:

(a) an actuator body; and (b) a passage way smoothly extending in a smooth curvilinear manner through said actuator body from an inlet end to an outlet end, for conveying the fluid from said inlet end to said outlet end thereof while attenuating accumulation of solidified material from the fluid within said passageway and on said actuator body;

wherein said actuator body defines, an axis and said body is divided along a plane parallel to said axis, and each divided segment having a facing surface, with an aligned groove formed in each facing surface and extending in a curvilinear manner from an inlet end to an outlet end, wherein said divided segments of said actuator body may be brought together with said grooves aligned so as to cooperatively form said passageway for conveying the fluid, said passageway extending smoothly in a curvilinear mariner from said inlet ends of said grooves to said outlet ends of said grooves.

22. The actuator of claim 21, further including a nozzle member having a frusto-conical chamber extending therethrough from an inlet end to an outlet end forming an orifice, wherein said nozzle member may be mounted on said actuator body with said inlet end of said frusto-conical chamber in smooth fluid communication with said second end of said passageway to direct the fluid being ejected from the actuator.

23. The actuator of claim 22, wherein said frusto-conical chamber of said nozzle member includes an axis that is inclined with respect to said axis of said actuator body to induce solidified material within said frustoconical chamber to drain towards said inlet end of said passageway.

24. The actuator of claim 21, further including a stem member having a conduit extending therethrough, wherein said stem member may be mounted on said actuator body about said inlet ends of said grooves when said divided segments are brought together to convey the fluid into said passageway.

25. An actuator for use with a dispenser for a fluid comprising:

(a) an actuator body; and (b) a passageway smoothly extending in a smooth curvilinear manner through said actuator body from an inlet end to an outlet end, for conveying the fluid from said inlet end to said outlet end thereof while attenuating accumulation of solidified material from the fluid within said passageway and on said actuator body;

wherein said actuator body includes:

(i) a main body portion including a cavity and a curvilinear surface extending within said cavity between a first opening and a second opening;

(ii) a cap having a curvilinear surface projecting therefrom; and (iii) means for mounting said cap on said main body portion with said main body portion curvilinear surface and said cap curvilinear surface cooperatively defining an enclosed passageway extending between said first opening and said second opening for conveying the fluid therethrough.

26. An actuator for use with a dispenser for a fluid, comprising:

(a) an actuator body; and (b) a passageway smoothly extending in a smooth curvilinear manner through said actuator body from an inlet end to an outlet end, for conveying the fluid from said inlet end to said outlet end thereof while attenuating accumulation of solidified material from the fluid within said passageway and on said actuator body; wherein said actuator is constructed of a unitary, molded body.

27. The actuator of claim 26, further including a nozzle member having a frusto-conical chamber extending therethrough from an inlet end to an outlet end terminating in an orifice, wherein said nozzle member may be mounted on said actuator body with said inlet end of said frusto-conical chamber in smooth fluid communication with said second opening of said passageway to direct the fluid being ejected from the actuator.

28. The actuator of claim 27, wherein said frusto-conical chamber of said nozzle member includes an axis that is inclined with respect to said axis of said actuator body to induce solidified material within said frustoconical chamber to drain towards said inlet end of said passageway.

29. The actuator of any of claims 1, 21, 25 or 26, mounted on a container having a reservoir for receipt of a quantity of the fluid, the actuator being in fluid communication with the fluid within the reservoir, further including means for propelling the fluid from the reservoir through said passageway of the actuator exteriorly of the container.

30. The actuator of claim 29, further including a quantity of the fluid in said reservoir of said container.

31. The apparatus of claim 29, wherein:

(a) said container further includes: (i) an access opening communicating between said reservoir and exteriorly of said container; and (ii) valve means mounted on said container about said access opening for controlling the flow of the fluid through said access opening, said valve means being shiftable between an open position and a closed position; and (d) said actuator is connected to said valve means exteriorly of said container for shifting said valve means between said open position and closed position.

* * * * *

UNITED STATES PATENT AND TRADEMARK OFFICE

CERTIFICATE OF CORRECTION

PATENT NO. : 5,480,095

DATED : January 2, 1996

INVENTOR(S) : William W. Stevenson, John C. Ruta, Bruce Sandison, and Russell E. Blette It is certified that error appears in the above-indentified patent and that said Letters Patent is hereby corrected as shown below:

Col. 1, line 2, after the numbers "27" insert therefor --0--.

Col. 1, line 10, after "containers" delete the "," and insert therefor --.--.

Col. 1, line 16, after "that is" insert therefor --, in--.

Col. 1, line 22, after FIG. 1 delete the "," and insert therefor --.--.

Col. 1, line 25, after "fluid 16" delete the "," and insert therefor --.--.

Col. 1, line 27, after "top closure 20" delete the "," and insert therefor --.--.

Col. 1, line 27, after "illustrated" delete the ",".

Col. 1, line 31, before "container" delete "one" and insert therefor --the--.

Col. 4, line 30, insert "-" between "cross" and "sectional".

Col. 5, line 17, insert "-" between "cross" and "sectional".

Col. 5, line 19, insert "-" between "cross" and "sectional".

Col. 5, line 21, insert "-" between "cross" and "sectional".

Col. 5, line 26, insert "-" between "cross" and "sectional".

Col. 5, line 62, delete "Penna." and insert therefor --Penn.--.

Col. 5, line 67, delete "Penna." and insert therefor --Penn.--.

UNITED STATES PATENT AND TRADEMARK OFFICE

CERTIFICATE OF CORRECTION

PATENT NO. : 5,480,095

DATED : January 2, 1996

INVENTOR(S) : William W. Stevenson, John C. Ruta, Bruce Sandison, and Russell E. Blette It is certified that error appears in the above-indentified patent and that said Letters Patent is hereby corrected as shown below:

Col. 8, line 31, before "and the dispersing tube" delete ".".

Col. 8, line 62, insert "-" between "frusto" and "conical".

Col. 10, line 2, insert "-" between "cross" and "sectional".

Col. 10, line 53, insert "-" between "cross" and "sectional".

Col. 11, line 23, insert "-" between "frusto" and "conical".

Col. 12, line 39, insert "-" between "frusto" and "conical".

Col. 12, line 39, delete "angle e" and insert therefor --angle $\alpha$--.

Col. 14, lines 4-5, after "100h" delete "of the male actuator".

Col. 17, line 41, delete "a inlet" and insert therefor --an inlet--.

Col. 17, line 41, delete "a outlet" and insert therefor --an outlet--.

Col. 19, line 11, delete "saidinlet" and insert therefor --said inlet--.

Col. 20, line 13, delete "mariner" and insert therefor --manner--.

UNITED STATES PATENT AND TRADEMARK OFFICE

CERTIFICATE OF CORRECTION

PATENT NO. : 5,480,095

DATED : January 2, 1996

INVENTOR(S) : William W. Stevenson, John C. Ruta, Bruce Sandison, and Russell E. Blette It is certified that error appears in the above-indentified patent and that said Letters Patent is hereby corrected as shown below:

Col. 22, line 13, delete "(d)" and insert therefor --(b)--.

Signed and Sealed this

Eighteenth Day of March, 1997

Bruce Lehman

*Attest:*

BRUCE LEHMAN

*Attesting Officer*

*Commissioner of Patents and Trademarks*